US010376025B2

(12) United States Patent
Cella et al.

(10) Patent No.: US 10,376,025 B2
(45) **Date of Patent: *Aug. 13, 2019**

(54) GEM APPLICATOR ASSEMBLY

(71) Applicant: GEMC2, LLC, Cochranville, PA (US)

(72) Inventors: Angie Cella, Cochranville, PA (US); Federico Diaz, Sleaford (GB); Matthew Mercier, Windermere, FL (US); John Burrill, Gotha, FL (US); Vishaal B. Verma, Evanston, IL (US); Bradley Abbott, Crowley, TX (US)

(73) Assignee: GEMC2, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/028,628

(22) Filed: Jul. 6, 2018

(65) Prior Publication Data

US 2019/0008241 A1 Jan. 10, 2019

Related U.S. Application Data

(63) Continuation-in-part of application No. 15/267,160, filed on Sep. 16, 2016, now Pat. No. 10,226,111.

(60) Provisional application No. 62/220,490, filed on Sep. 18, 2015, provisional application No. 62/301,665, filed on Mar. 1, 2016.

(51) Int. Cl.

| | |
|---|---|
| ***A44C 15/00*** | (2006.01) |
| ***B44C 1/18*** | (2006.01) |
| *A45D 8/00* | (2006.01) |

(52) U.S. Cl.

CPC ..... *A44C 15/006* (2013.01); *B44C 1/18* (2013.01); *A45D 2008/002* (2013.01); *A45D 2008/008* (2013.01)

(58) Field of Classification Search

None

See application file for complete search history.

(56) References Cited

U.S. PATENT DOCUMENTS

2007/0028942 A1* 2/2007 Leung ..... A45D 2/00 132/333

* cited by examiner

*Primary Examiner* — Gene O Crawford
*Assistant Examiner* — Ayodeji T Ojofeitimi
(74) *Attorney, Agent, or Firm* — Massina Pat & TM Law PLLC

(57) ABSTRACT

A gem applicator assembly including a dispenser supporting a plurality of gems and an applicator. Each gem has an adhesive backing. The applicator includes a body with a support assembly supported by the body and configured to receive and support the dispenser with one of the gems alignable with an application target area. A plunger is supported relative to the body and movable relative thereto between an initial position and an application position wherein the push rod engages the aligned gem and pushes the gem such that the adhesive backing of an aligned gem moves toward the application target area. The gem dispenser may include a disk configuration with a plurality of spaced apart gem openings extending through the disk. Each gem is aligned with a respective gem opening.

20 Claims, 23 Drawing Sheets

GEM APPLICATOR ASSEMBLY

This application is a continuation-in-part of U.S. application Ser. No. 15/267,160, filed on Sep. 16, 2016, which claims the benefit of U.S. Provisional Application No. 62/220,490, filed on Sep. 18, 2015, and U.S. Provisional Application No. 62/301,665, filed on Mar. 1, 2016. The contents of each of these applications are incorporated herein by reference.

FIELD OF THE INVENTION

This disclosure relates to application of gems to hair, ribbons, notebooks, dolls hair, artwork, paper, cloth and other items. More particularly, the invention relates to a gem applicator configured to apply gems and a dispenser configured to support the gems for application.

BACKGROUND OF THE INVENTION

There are two companies marketing 'gems' for hair. One device uses batteries to affix a spring-loaded plastic jewel to the hair. The child has to manually insert each jewel into the device and then they need to have an adult help them to remove the jewels—it can damage the hair. The other device utilizes gems sold in sheets which are applied to the hair using a heating element, such as a flat iron. Both require electricity and significant effort either in applying or in removing the gems.

SUMMARY OF THE INVENTION

In at least one aspect, the present invention provides a gem applicator which provides the ability to apply gems more easily and with much more versatility. It is a simple and affordable handheld device that efficiently and quickly applies crystals, rhinestones or other gems (with adhesive already on them) to the hair, paper, cloth, etc. (material) without heat, batteries, or electricity and without any damage to the hair. Simply place a section of the material into the application area of the device, squeeze the trigger and the gem is applied. In the case of gems applied to hair, the gems may be removed by simply brushing them out.

In at least one embodiment, the present invention provides a gem applicator assembly including a dispenser supporting a plurality of gems and an applicator. Each gem has an adhesive backing. The applicator includes a body with a support assembly supported by the body and configured to receive and support the dispenser with one of the gems aligned with an application target area. A plunger having a push rod is supported by the body and movable relative thereto between an initial position and an application position wherein the push rod engages the aligned gem and pushes the aligned gem such that the adhesive backing of the aligned gem moves toward the application target area. The gem dispenser may include a circular disk configuration with a plurality of spaced apart gem openings extending through the disk. Each gem is aligned with a respective gem opening.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
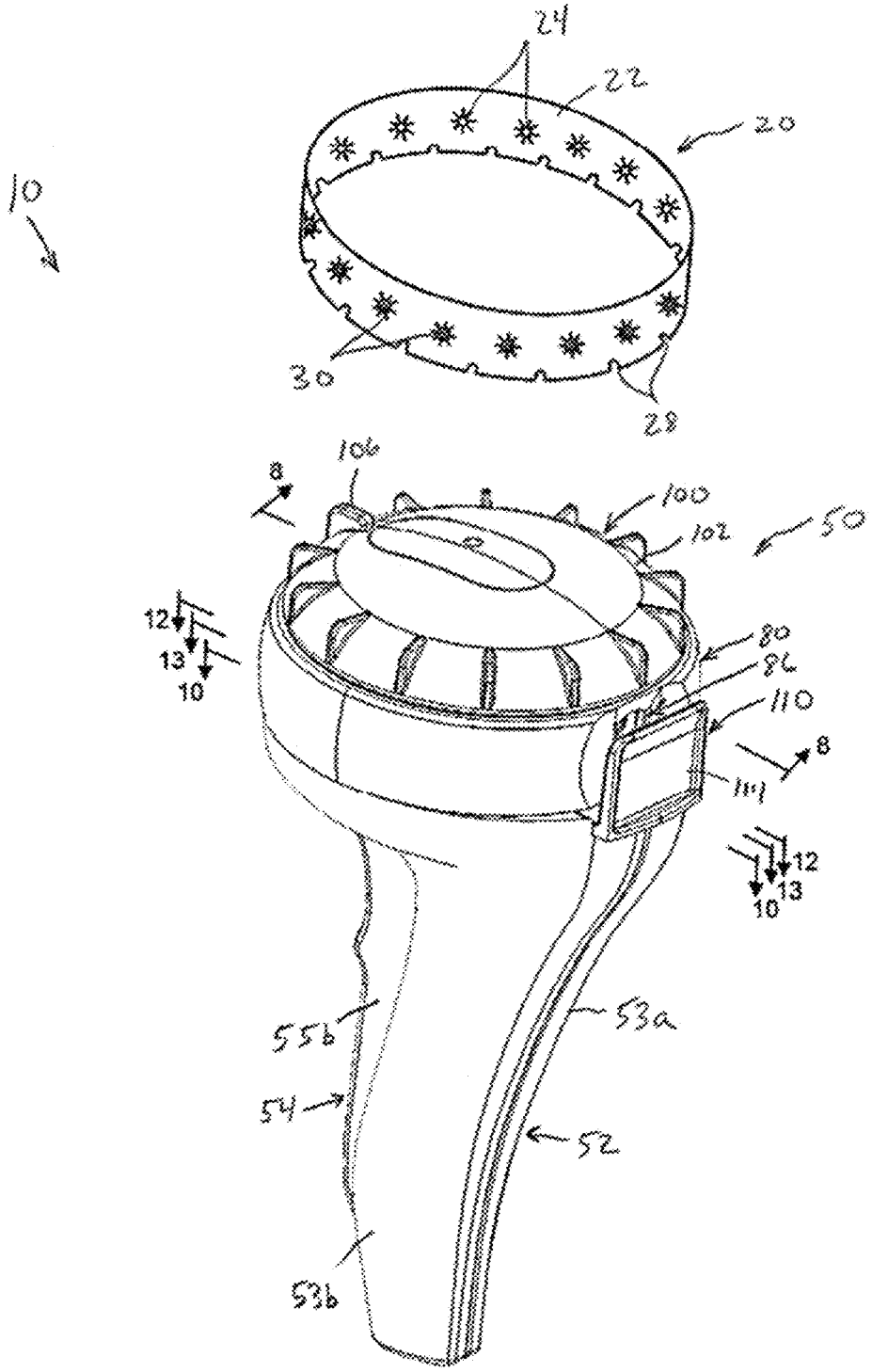
FIG. 1 is a perspective view of a gem applicator assembly in accordance with an embodiment of the invention including an exemplary applicator and an exemplary dispenser.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to FIGS. 1-14, an exemplary embodiment of a gem applicator assembly 10 in accordance with the disclosure will be described. As used herein, the term gem encompasses items of various shapes and sizes and made from various materials including natural and synthetic materials, including crystals, plastics, rhinestones, glass beads, pearls and the like. The gems have an adhesive which causes them to adhere to the intended material. In applications wherein the gems are applied to hair, the adhesive is selected such that it is safe for hair and skin.

Figure 6:
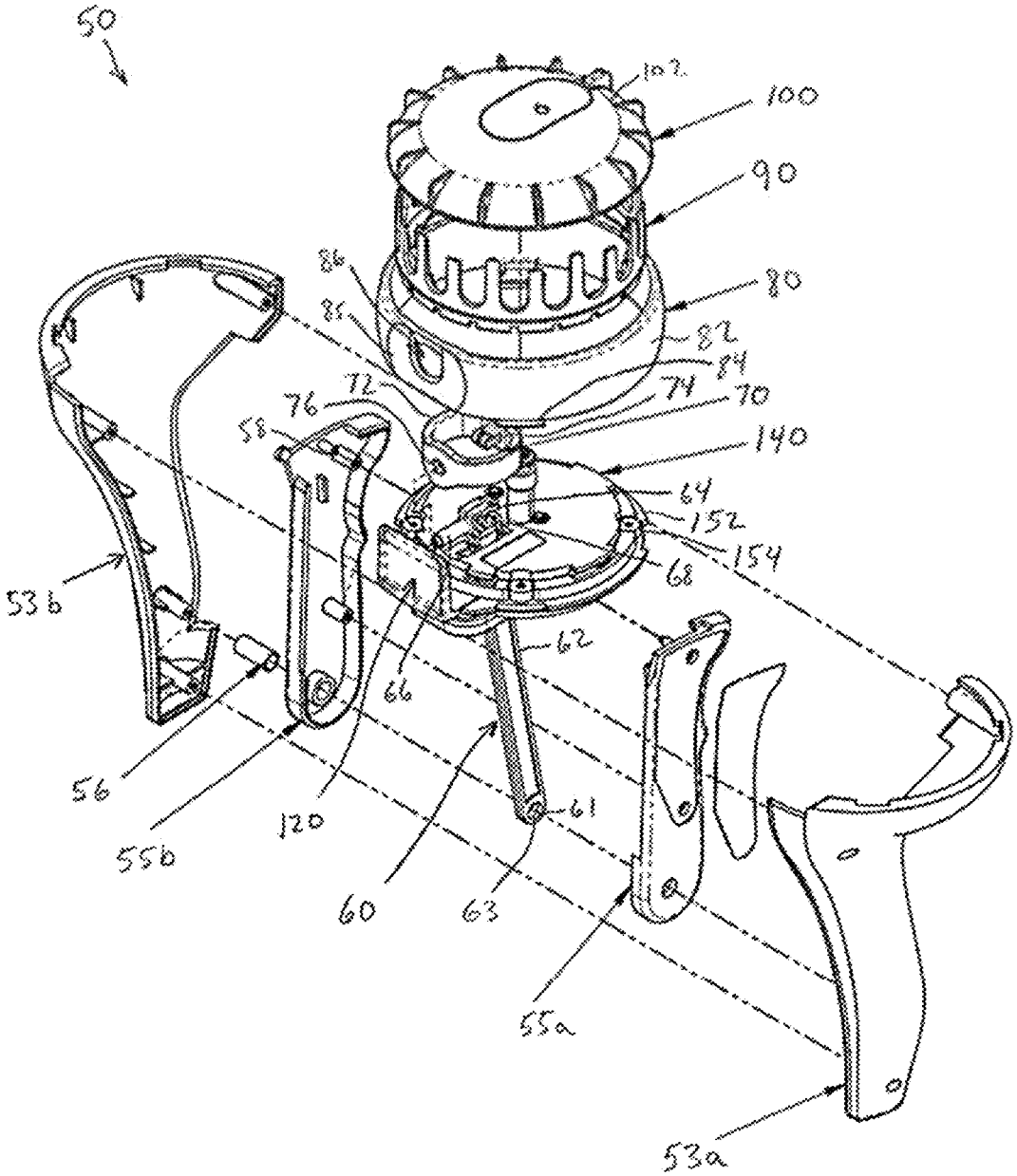
FIG. 6 is an exploded perspective view of the applicator of FIG. 1.

Referring to FIGS. 1 and 6, the exemplary gem applicator assembly 10 generally comprises a gem dispenser 20 and a gem applicator 50. The gem applicator 50 is a purely mechanical device, to facilitate applying gems, for example, crystals, to hair, paper, cloth and or other materials (application target). In the present embodiment, the gem dispenser 20 is in the form of a belt which will be easily inserted into the applicator 50 via a removable cover assembly 100. The removable cover assembly 100 provides an easy operation to replace the gem belt 22 so that, for instance, the user can change the color, shape and size of the gem the user wants to apply next. The applicator assembly 10 will cater for gems 30 of different size and shapes, thus making it more versatile in its use.

The applicator 50 includes a hollow handle body 52, an outer drum cover 80 supported on the handle body 52, and the cover assembly 100. The belt 22 is supported by a belt drum 90 which is within the drum cover 80. The internal belt drum 90 is engaged by the cover assembly 100 such that rotation of the cover 102 causes rotation of the belt 22 to align a gem 30 with an opening 86 in the drum cover 80. Such a manual rotation of the belt 22 allows a user to align a desired gem 30 with the opening 86 to apply the desired gem 30. This may also be useful where a belt 22 has some of the gems 30 missing, for example, the gems have already been used, and the user wants to advance the belt 22 to the next gem 30 that can be applied. As will be described in more detail hereinafter, the applicator 50 may include an indexing assembly 140 to automatically advance the belt 22 in addition to or in place of the manual rotation.

To apply a gem 30, the applicator 50 operates with a trigger 54 pivotally supported by the handle body 52. The trigger 54 pushes a plunger 60 (see FIG. 6) which in turn presses a gem 30 through the outer ring opening 86 and against the location on the hair or other material where it is wanted. In order to press the gem firmly against the hair, so that it stays in place long enough, a portion of the applicator 50 serves as a backing plate 114 to press the gem against the hair. The trigger mechanism may serve a double function whereby it is also part of the indexing assembly such that it advances the belt with gems one position, each time it is pressed. Such allows the user to install the gems in succession, one each time the trigger is pressed.

Figure 2:
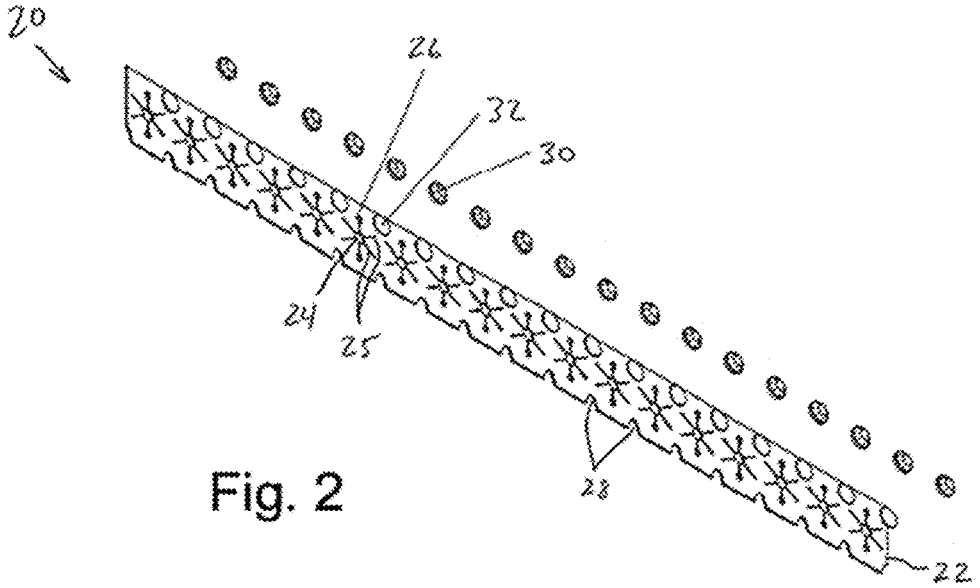
FIG. 2 is an exploded perspective view of an exemplary dispenser in the form of a belt.
Figure 3:
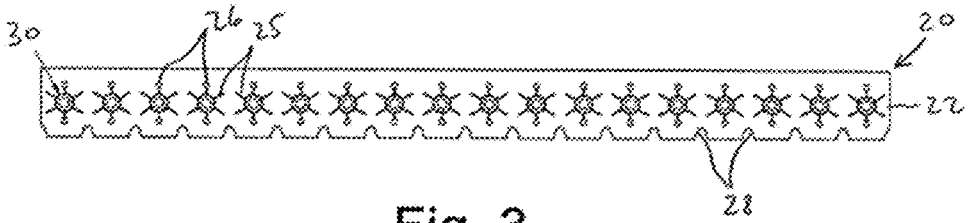
FIG. 3 is a front elevation view of the belt of FIG. 2.
Figure 4:
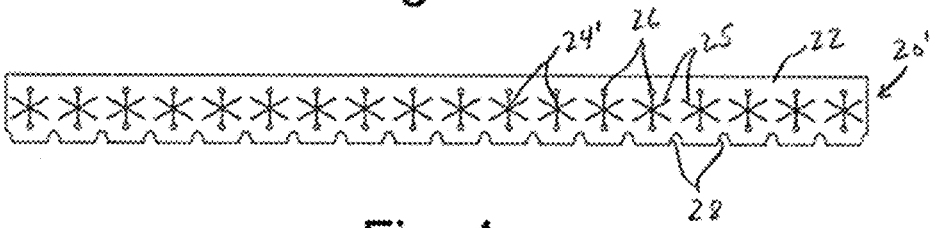
FIG. 4 is a rear elevation view of another exemplary belt.

Referring to FIGS. 2-4, exemplary gem dispensers 20, 20' in the form of belts 22 will be described. Each belt 22 is a strip with a series of spaced apart gem openings 24, 24'. The size of the openings 24, 24' are preferably selected to correspond to the size of the gem 30. For example, the belt 22 of FIGS. 2 and 3 would supports gems 30 which are larger than the gems supported on the belt 22 of FIG. 4. In each case, the openings 24, 24' are preferably provided with a series of radial slits 25. Furthermore, some of the slits 25 may terminate in openings 26. The radial slits 25 and openings 26 allow the material of the belt 22 to deform as the gem 30 is pressed through the opening 24, 24' and thereby guide the gem 30 to the application material (hair, paper, cloth, etc.). The shape also prevents the belt from sticking to the plunger. The shape of the gem mounting can be modified to accommodate different sizes and shapes of gems.

As illustrated in FIG. 2, an adhesive material 32 is positioned on the back surface of each gem 30 to facilitate adhering of the gem 30 to the intended surface. An exemplary adhesive material 32, when the gems 30 are applied to hair, is 3M 1522 acrylic adhesive. In at least one embodiment, the belt 22 is polystyrene material with a polyester non-stick coating. The coating is designed to partially adhere to the acrylic adhesive material 32 on the gem 30. Other exemplary belt materials include polyester, polycarbonate, paper, styrene, acrylic, polyethylene, polypropylene, and many other polymers. Exemplary coatings include polyester, silicone, fluorinated materials, olefin materials, and other materials that resist adhesion by acrylic adhesives.

Figure 5:
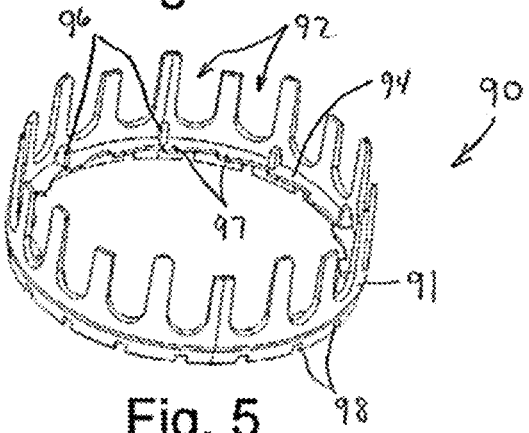
FIG. 5 is a perspective view of an exemplary belt drum of the applicator of FIG. 1.

The dispenser 20 is configured to be supported within the applicator 50 by a support assembly such that the gems 30 may be applied utilizing a mechanical application mechanism. In the present embodiment of the applicator assembly 10, the support assembly is a belt drum 90 as illustrated in FIG. 5. Each belt 22 is configured to be positioned within and supported by the belt drum 90. The belt drum 90 has a cylindrical body 91 with a series of drum openings 92, each of which aligns with a respective gem 30. A support surface 94 extends radially inward from the cylindrical body 91 to support the belt 22. To align the belt 22 and to ensure the belt 22 moves with the drum 90, the drum 90 includes a plurality of tabs 96 which engage corresponding notches 28 in the belt 22.

Figure 7:
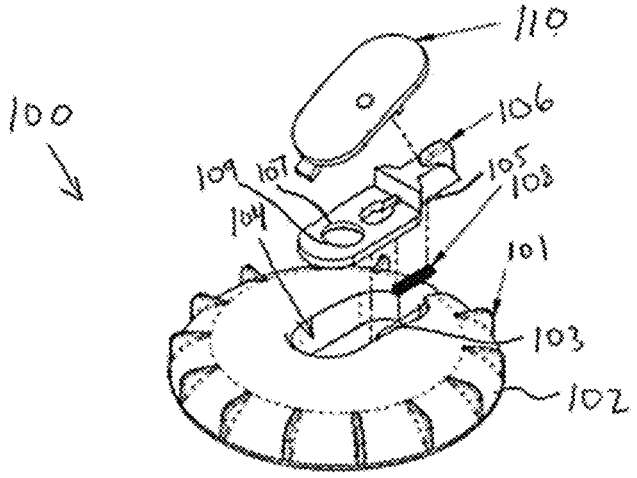
FIG. 7 is an exploded perspective view of an exemplary cover assembly of the applicator of FIG. 1.
Figure 8:
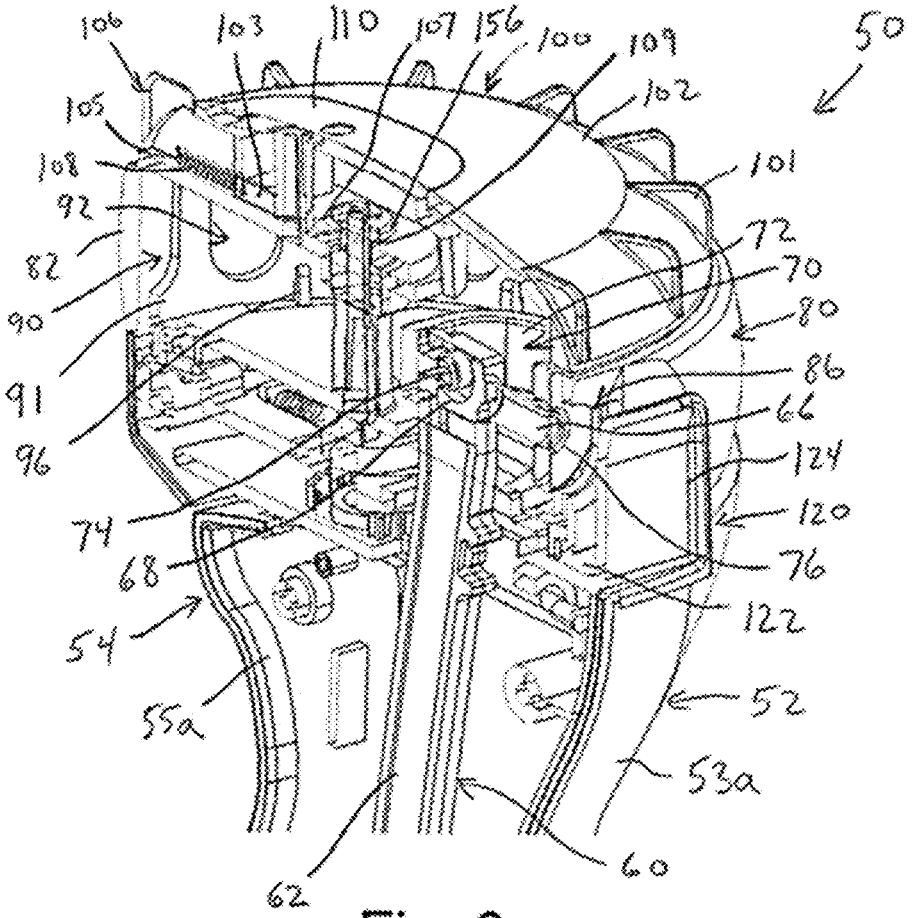
FIG. 8 is a cross-sectional view along the line 8-8 in FIG. 1.

Referring to FIGS. 6-8, the components of the gem applicator 50 of the present embodiment will be described. The exemplary applicator 50 generally includes: a handle body 52 to support all components, the drum 90 rotatably supported by the body 52, the drum cover 80 which extends about the drum 90 and may be formed integrally with or separately from the body 52 and which may be transparent, a removable cover assembly 100 to insert the belt and which may also be transparent and which may double up as a knob to turn the belt 22; (the transparent parts will allow the user to see what gems are still inside), the indexing mechanism 140 to automatically advance the belt 22 to each gem position for application, the trigger 54 to drive the plunger 60 to push the gem 30 through the opening 86 in the drum cover 80 and toward the backing plate 114 to apply the gem. The body 52 or trigger 54 may include a raised grip.

In the illustrated embodiment, the handle body 52 is formed by opposed body shell members 53*a*, 53*b*. The body shell members 53*a*, 53*b* may be joined to one another via screws, snap fit or in various other manners. The trigger 54 similarly comprises opposed trigger members 55*a*, 55*b* which are joined together to form the trigger. It is understood that both the body 52 and the trigger 54 may be made from more or fewer components. The trigger 54 is pivotally supported relative to the body 52 by, for example, a bushing 56.

The trigger 54 is configured to pivotally move the plunger 60. In the illustrated embodiment, the plunger 60 includes an axial body 62 extending between a pivot end 61 and a head 64. The pivot end 61 includes a through bore 63 configured to receive the bushing 56 such that the plunger 60 pivots with the trigger 54. The head 64 includes a push rod 66 which is configured to extend through a respective drum opening 92 and the drum cover opening 86 when the trigger is activated. With such movement, the push rod 66 engages the gem 30 and pushes it through the belt opening 24, 24', the drum opening 92 and the drum cover opening 86 where it is adhesively applied to the intended item at the drum cover opening 86.

A resilient member 70 engages the plunger 60 and is configured to bias the plunger 60 to an initial position withdrawn from the opening 86. In the illustrated embodiment, the resilient member 70 is a ring 72 made of elastomeric material, for example, rubber or the like. The resilient member 70 includes an inwardly protruding connector 76 which is configured to be received and retained in a corresponding groove 68 on the back of the plunger head 64. The opposite side of the ring 72 has a through hole 76 which aligns with the drum cover opening 86. When the plunger 60 is actuated, the ring 72 is compressed between the plunger head 64 and the inside of the drum 90 (see FIG. 8). Upon release of the trigger 54, the resilient nature of the ring 72 causes the plunger 60 to move to the initial position. While an elastomeric ring is illustrated, the resilient member 70 may have other configurations, for example, a spring or the like.

As described above, the plunger head 60 is surrounded by the drum 90 and the drum cover 80. The drum cover 80 preferably has a generally cylindrical body 82 although other configurations are possible. As illustrated, the area of the opening 86 preferably includes a flattened area 85 of the body 82. Tabs 84 extend from the bottom edge of the body 82 and are configured for connection to the body 52, however, other mechanism of attachment may be utilized. Alternatively, the drum cover 80 may be formed integrally with the body 52. The drum 90 is rotatably positioned within the drum cover 80. In the illustrated embodiment, the drum 90 is positioned on a support surface 152 of an upper plate 150 of the indexing assembly 140. The upper plate 150 supports a plurality of drum rollers 154 which assist the rotation of the drum 90.

To access the drum 90 and to position belts 22 within the drum cover 80, the cover assembly 100 includes a removable cover 102. In the illustrated embodiment, the cover 102 includes a series of radial projections 101 which assist with manual rotation of the cover 102, and thereby the drum 90. The cover 102 defines an internal slot 104 into which a release button 106 is positioned. A spring 108 is positioned between a tab 103 in the slot 104 and a tab 105 on the release button 106 to bias the release button radially outward. The release button 106 has a through passage 107 with an inner contact surface 109.

Figure 9:
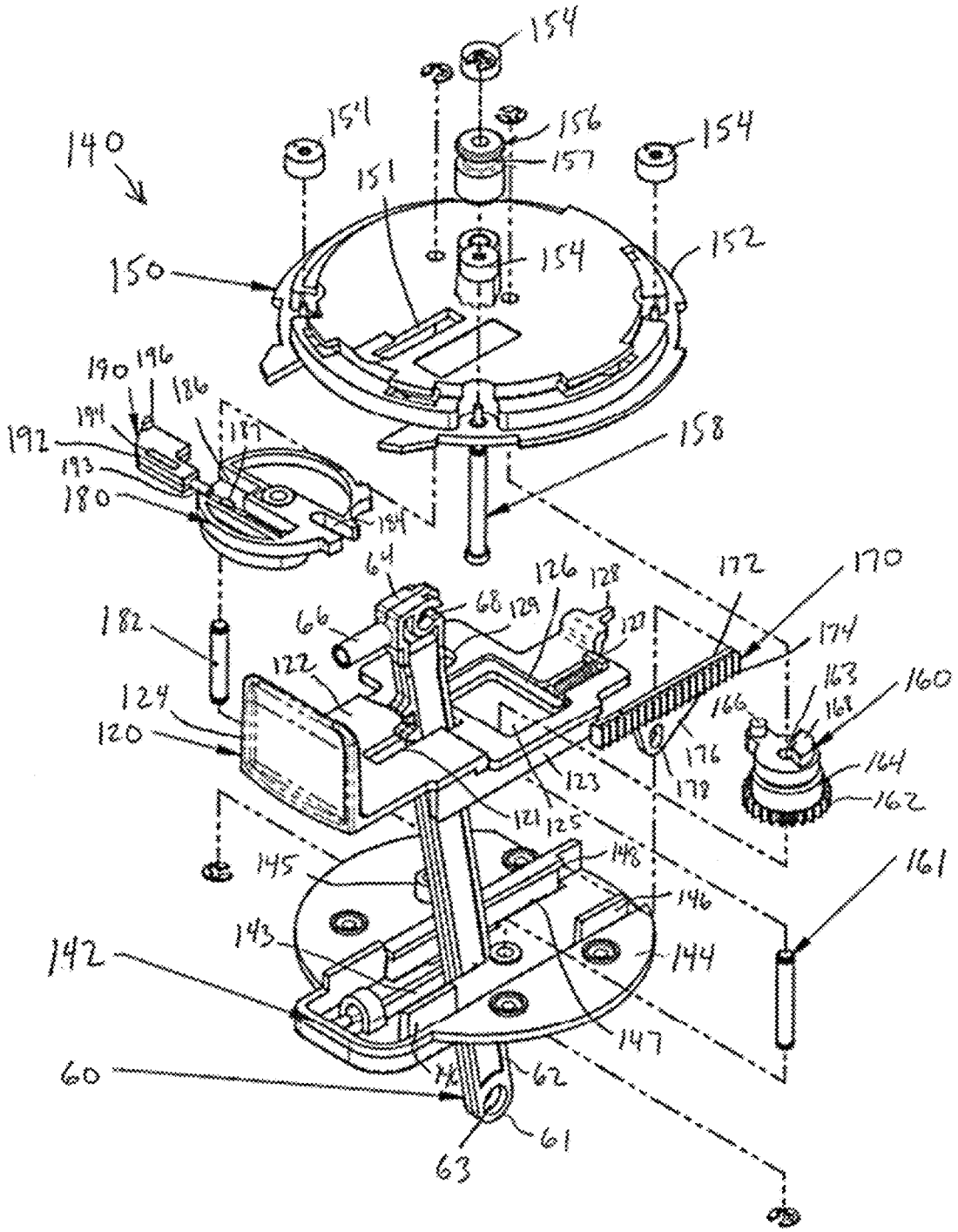
FIG. 9 is an exploded perspective view of an exemplary indexing assembly of the applicator of FIG. 1.

Referring to FIGS. 8 and 9, the through passage 107 is configured such that an internal top bearing 156, which is positioned on a center pivot pin 158 extending from the upper plate 150 and which defines a retaining groove 157, extends through the passage 107 with the groove 157 aligned with the inner contact surface 109. When the release button 106 is in its normal position due to the bias of the spring 108, the inner contact surface 109 is received in the groove 157 and the cover assembly 100 is axially secured relative to the drum cover 80 and body 52. The cover 102 is still free to rotate relative to the drum cover 80 as the push button 106 simply rotates about the top bearing 156. To remove the cover 102, the release button 106 is pressed radially inward such that the inner contact surface 109 is disengaged from the groove 157 and the top bearing 156 is aligned with the through passage 107 such that the cover may be lifted off. A cover plate 110 may extend over the slot 104.

Figure 10:
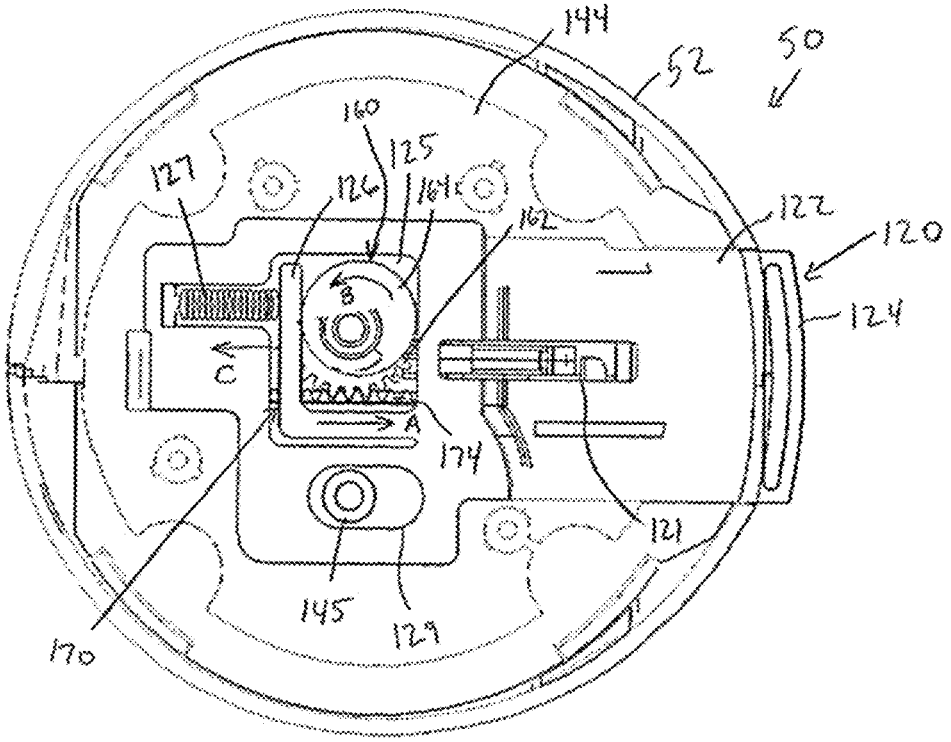
FIG. 10 is a cross-sectional view along the line 10-10 in FIG. 1.

Turning to FIGS. 8-10, an exemplary backing plate assembly 120 and indexing assembly 140 will be described. The backing plate assembly 120 includes a body 122 which extends into the handle body 52 and a backing plate 124 which extends generally perpendicular to the body 122, outside of the handle body 52 in alignment with the drum cover opening 86. The backing plate 124 provides a generally rigid support surface as the gem 30 is applied. In the illustrated embodiment, the indexing assembly 140 is configured to advance the drum 90 each time the trigger 54 is actuated and to also move the backing plate 124 toward the plunger push rod 66 while the trigger 54 is pressed to reduce the gap between the backing plate 124 and the drum cover 80.

The initial position of the backing plate 124 allows the user to add materials including hair, paper, cloth, etc. into the gap formed by the backing plate 124 and drum cover 80 with a relatively wider opening. When the trigger 54 is pressed, the backing plate 124 moves toward the plunger 60, providing a reliable support surface. As the trigger is released, the backing plate 124 returns to the open position to allow the user to remove the material with the gem applied. By opening the gap between the drum cover 80 and backing plate 124, the applied gem can clear the drum cover 80 and plunger 60 and be removed without being stripped from the material.

Referring to FIG. 9, the backing plate assembly body 122 includes downwardly extending rails 123 which engage upwardly extending rails 146, 148 of the bottom plate 142 of the indexing assembly 140 to guide axial movement thereof. The backing plate assembly body 122 may also include a slot 129 which receives a pin 145 extending from the bottom plate 142 to define the axial range of motion of the backing plate assembly 120. It is noted that the backing plate assembly body 122, the bottom plate 142, and the upper plate 150 have respective slots 121, 143, 151 through which the plunger 60 extends and is movable within.

In the present embodiment, the movement of the backing plate assembly 120 is facilitated by a cam gear 160 and a gear rack 170 of the indexing assembly 140. The gear rack 170 has a linear body 172 with a plurality of teeth 174 extending therefrom. The gear rack 170 is configured to move along the bottom plate 142 and is supported against one of the rails 148. A flange 176 extends from the linear body 172 and extends through a slot 147 in the bottom plate 142 such that a bore 178 in the flange 176 is below the bottom plate 142 and extends into the trigger 54. A bushing 58 within the trigger 54 (see FIG. 6) extends through the bore 178 such that movement of the trigger 54 causes linear movement of the gear rack 170.

The cam gear 160 includes a plurality of circumferential teeth 162. The cam gear 160 is rotatably mounted on the bottom plate 142 via a cam gear pin 161 and is aligned such that the circumferential teeth 162 engage the gear rack teeth 174. As such, as the trigger 54 is moved, the cam gear 160 is rotated in response thereto. The cam gear 160 includes an eccentric body portion 164 above the teeth 162 that extends through an opening 125 in the backing plate assembly body 122 and aligns with an arm 126. Referring to FIG. 10, when the trigger 54 is depressed, the gear rack 170 moves as indicated by arrow A, which in turn causes the cam gear 160 to rotate as indicated by arrow B. As the cam gear 160 rotates, the eccentric body portion 164 engages the arm 126, thereby causing the backing plate assembly body 122 and backing plate 124 to move in the direction of arrow C. When the trigger 54 is released, the gear rack 170 and cam gear 160 move in the opposite direction, returning the backing plate 124 to the original position.

It is noted that the arm 126 and spring 127 in the illustrated embodiment provide flexibility. Since the material may have different thickness, the spring 127 allows the backing plate assembly 120 to accommodate thin or thick material without damaging the mechanism. If a thick piece of material is placed in the backing plate gap, as cam gear rotates, the backing plate assembly body 122 will not be able to move, however, the arm 126 will simply push against and compress the spring 127 rather than moving the backing plate. When thinner material is placed in the gap, the spring 127 is not compressed and the backing plate 124 moves in response to the cam gear 160.

Figure 11:
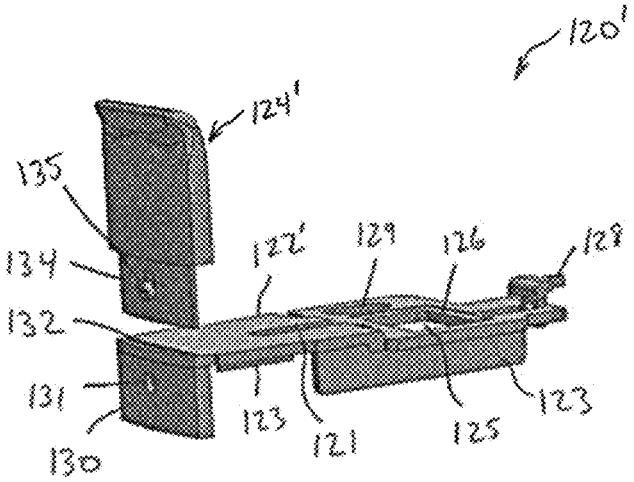
FIG. 11 is a perspective view of alternative backing plate assembly in accordance with an embodiment of the disclosure.

Referring to FIG. 11, an alternative backing plate assembly 120' is illustrated. The backing plate assembly 120' is substantially the same as in the previous embodiment except that the backing plate 124' is removable. A removable backing plate 124' allows the applicator 50 to be used to apply gems to a material which would not fit in the gap between the drum cover 80 and backing plate 124'. In the illustrated embodiment, the backing plate assembly body 122' includes a rear body portion 130 with a receiving slot 132 defined therein. A locking hole 131 extends through the rear body portion 130 into communication with the receiving slot 132. The removable backing plate 124' includes a depending tab 134 which is configured to be received in the receiving slot 132. A locking projection 134 extends from the tab 134 and is configured to engage within the locking hole 131 to lock the removable backing plate 124' to the back plate assembly body 122'. To remove the removable backing plate 124', the locking projection 134 is depressed until it clears the locking hole 131. Other removable connection assemblies are contemplated, for example, a snap fit, a friction fit, a dovetail connection, or a threaded connection. Other than described, the backing plate assembly 120' functions in a similar manner to the previously described embodiment.

Referring to FIGS. 9 and 12-14, the indexing function of the indexing assembly 140 will be described. The cam gear 160 further supports an indexing pin 166 which moves when the circumferential teeth 162 are engaged by the gear rack teeth 174. The indexing pin 166 is received within an index slot 184 of the indexing arm support 180. The indexing arm support 180 is pivotally supported relative to the bottom plate 142 via a pin 182. The indexing arm support 180 defines a slot 186 configured to receive the indexing arm 190 and guide reciprocal axial motion thereof. The indexing arm 190 includes a body 192 with a guide slot 194 which receives a tab 187 extending within the slot 186. Engagement of the tab 187 within the guide slot 194 defines the axial range of motion of the indexing arm 190. The indexing arm body 192 includes a post 193 configured to engage a spring 188 within the slot 186 such that the indexing arm 190 is biased radially outward. An engagement surface 196 is defined on the outer portion of the indexing arm 190. The engagement surface 196 is configured to engage the inward ramped surfaces 97 of the drum 90. Upon engaging the flat portion of the ramped surfaces 97, the engagement surface 196 causes the drum 90 to rotate. When moving in the opposite direction, i.e. during release of the trigger or when the drum is rotated manually, and engaging the tapered portion of the ramped surfaces 97, the spring 188 allows the indexing arm 190 to move radially inward and ride over the ramped surfaces 97. A block 168 extending from the cam gear 160 defines a rotational stop in both directions for the indexing arm support 180.

Figure 12:
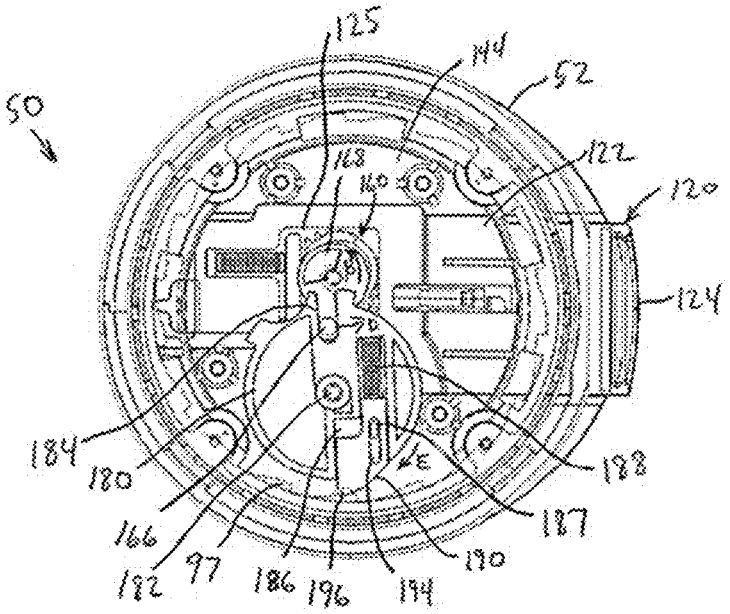
FIG. 12 is a cross-sectional view along the line 12-12 in FIG. 1.

In operation, when the trigger 54 is actuated, the cam gear 160 rotates in the direction indicated by arrow B in FIG. 12 which in turn causes the indexing pin 166 to move in the direction indicated by arrow D. As the indexing pin 166 moves along the index slot 184 of the indexing arm support 180, the indexing arm support 180 rotates in the direction indicated by arrow E, thereby moving the engagement surface 196 of the indexing arm 190 to engage the flat portion of the next ramped surface 97, which in turn causes the drum 90 to automatically rotate and move the next gem into position.

Figure 13:
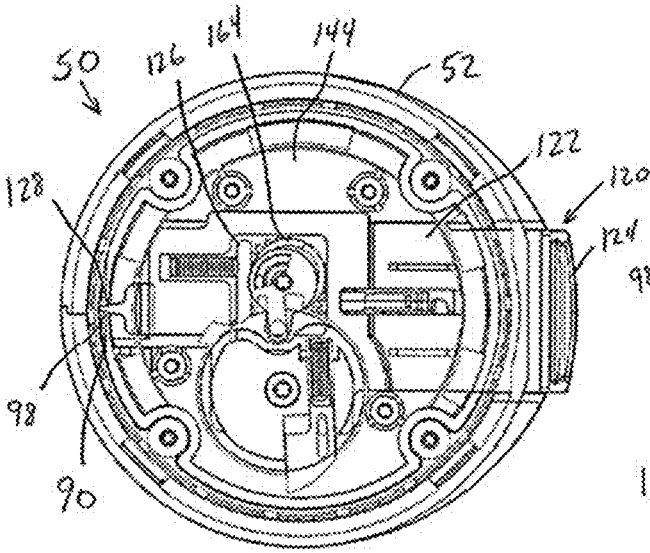
FIG. 13 is a cross-sectional view along the line 13-13 in FIG. 1.
Figure 14:
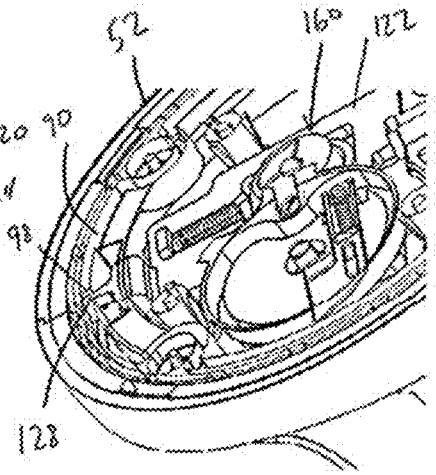
FIG. 14 is a perspective view of the applicator as illustrated in FIG. 13.
Figure 15:
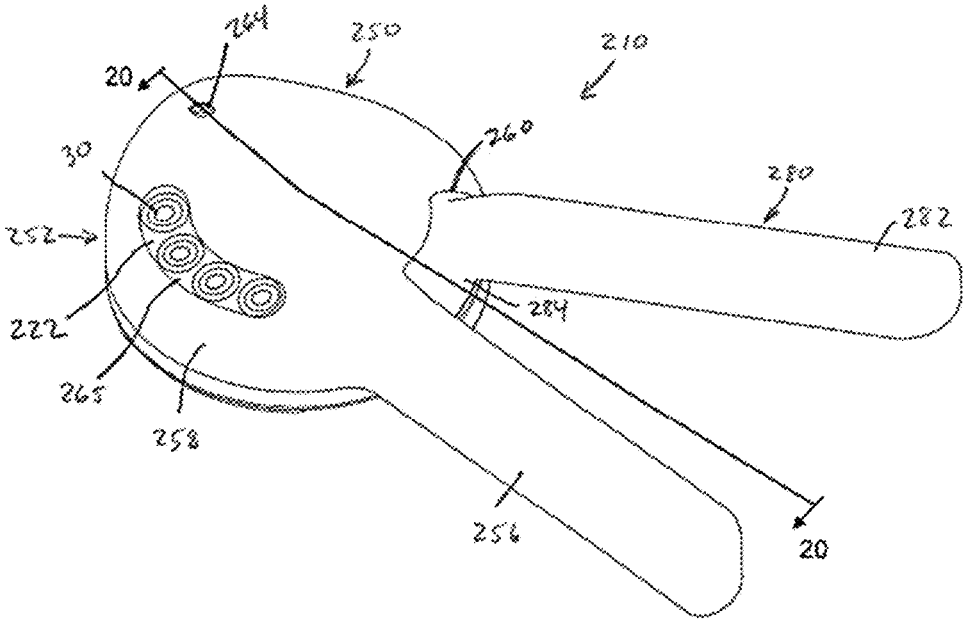
FIG. 15 is a perspective view of a gem applicator assembly in accordance with another embodiment of the disclosure.
Figure 16:
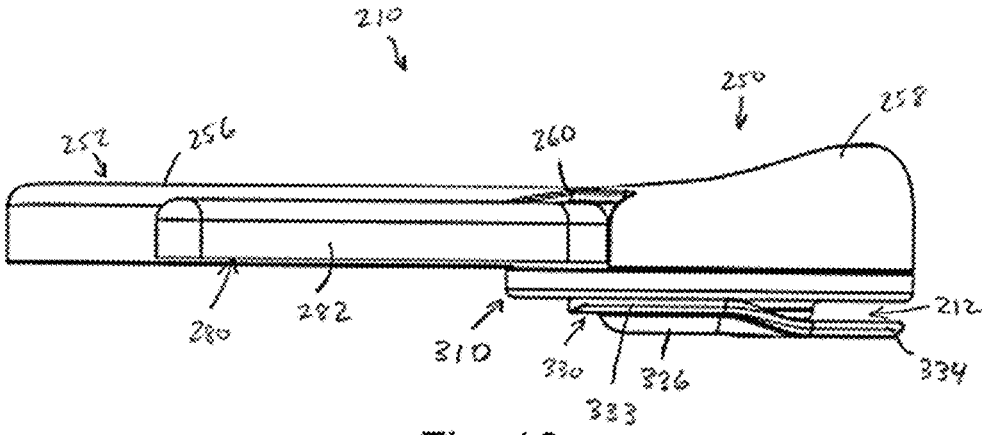
FIG. 16 is a side elevation view of the gem applicator assembly of FIG. 15.

To hold the drum 90 in place during application, a holding pin 128 is configured to engage a respective notch 98 of the drum 90 when the trigger is actuated as illustrated in FIGS. 13 and 14. In the illustrated embodiment, the holding pin 128 is formed integral with the backing plate assembly body 122 and moves when the trigger 54 is actuated. The holding pin 128 may be formed as a separate component. The holding pin 128 moves into engagement with the drum notch 98 when the indexing motion is complete. This centers the gem 30 in preparation for application and holds the drum 90 in place while the gem 30 is applied. The pin 128 is retracted, allowing the drum 90 to move, when the trigger 54 is released.

Having generally described the components, an exemplary method of applying and indexing the gems will be described. The actuating trigger initially moves the gem to the application position. Further trigger movement pushes the gem from the belt to a material (hair, paper, cloth). Further trigger movement applies the gem to the material. Releasing the trigger resets the belt indexing mechanism.

In the illustrated embodiment, the applicator 50 can index up to 18 gems. The applicator 50 and belt 22 can be configured to index more or fewer gems. The belt can be in a ring or linear strip configuration. The belt can be removed and a new one re-loaded to provide more gems. No heat or electricity is required to apply or index gems. Other configurations of the applicator assembly 10 could use dispensers in the form of rings, linear strips, or disks to carry the gems.

Referring to FIGS. 15-32, another exemplary embodiment of a gem applicator assembly 210 in accordance with the disclosure will be described. Referring to FIGS. 15-21, the exemplary gem applicator assembly 210 generally comprises a gem dispenser 220 and a gem applicator 250. The gem applicator 250 is a purely mechanical device, to facilitate applying gems, for example, crystals, to hair, paper, cloth and or other materials (application target). In the present embodiment, the gem dispenser 220 is in the form of a disk which will be easily inserted into the applicator 250 via a removable cover assembly 310. The removable cover assembly 310 provides an easy operation to replace the gem disk 222 so that, for instance, the user can change the color, shape and size of the gem the user wants to apply next. The applicator assembly 210 will cater for gems 30 of different size and shapes, thus making it more versatile in its use.

The applicator 250 includes a hollow handle body 252, an actuation trigger 280 and the cover assembly 310. The disk 222 is supported between the handle body 252 and the cover assembly 310. The disk 222 is engaged by an indexing assembly associated with the actuation trigger 280 such that rotation of the actuation trigger 280 causes rotation of the disk 222 to align a gem 30 with an opening 315 in the cover assembly 310. The actuation trigger 280 also drives the plunger 270 to push the gem 30 through the opening 315 in the cover assembly 310 and toward the application target area 212 to apply the gem 30. A backing plate 330 may be utilized as a support at the application target area 212.

Figure 17:
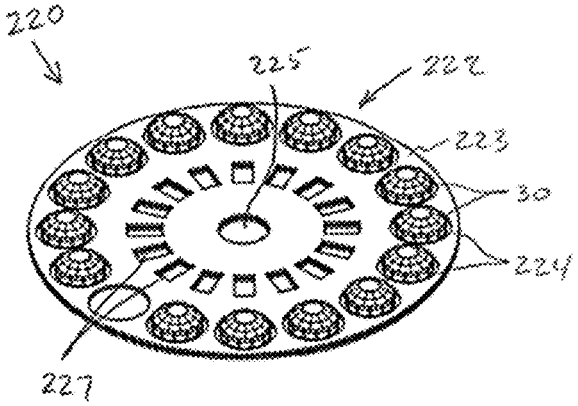
FIG. 17 is a perspective view of another exemplary dispenser in the form of a disk.
Figure 18:
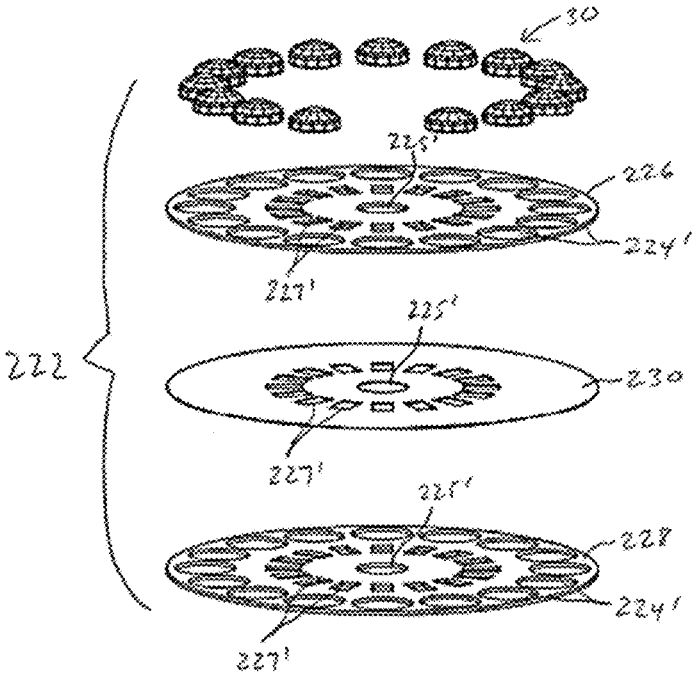
FIG. 18 is an exploded perspective view of the disk of FIG. 17.
Figure 19:
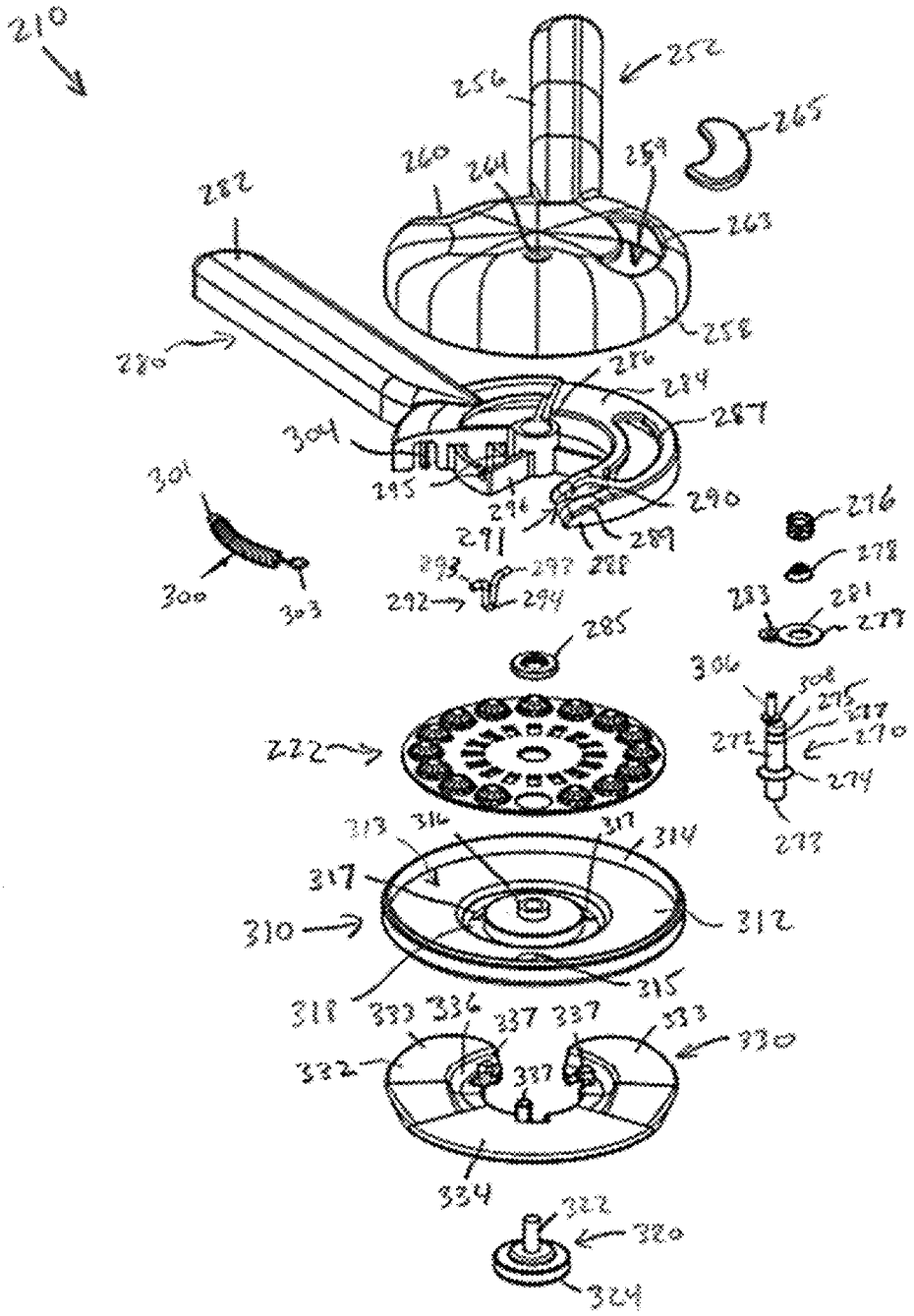
FIG. 19 is an exploded perspective view of the gem applicator assembly of FIG. 15.
Figure 20:
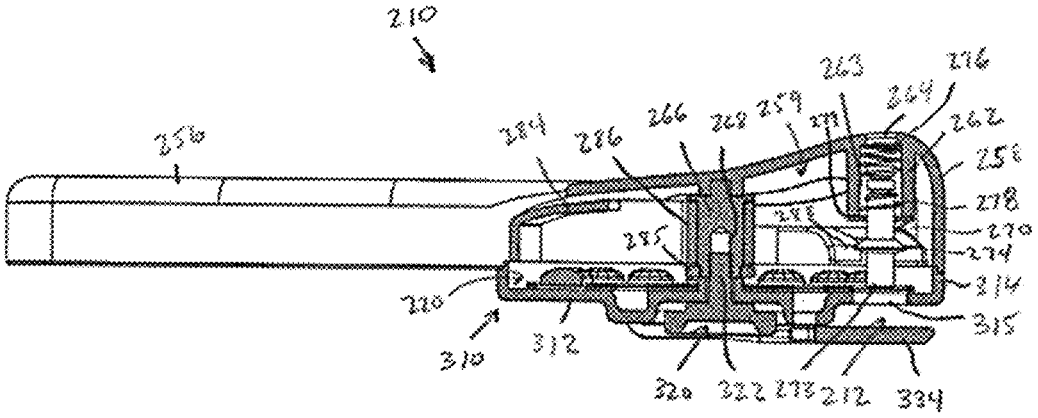
FIG. 20 is a cross-sectional view along the line 20-20 in FIG. 15.
Figure 21:
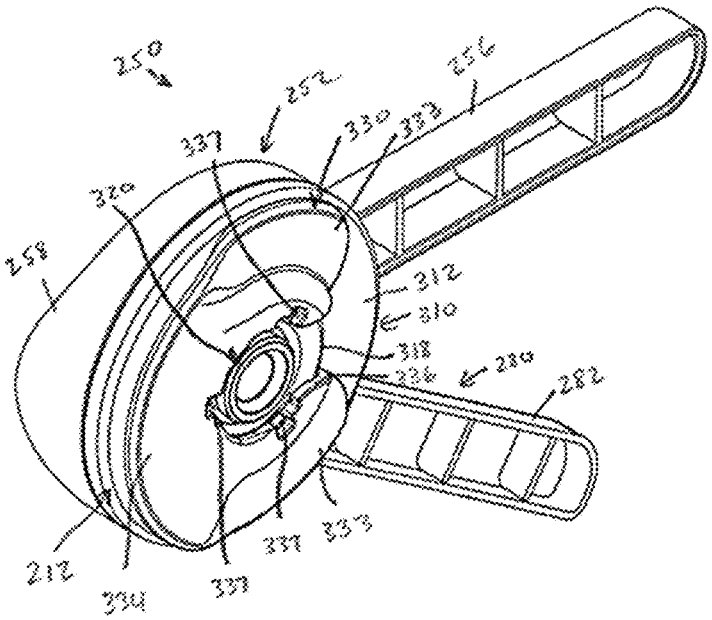
FIG. 21 is a bottom perspective view of the gem applicator assembly of FIG. 15.
Figure 22:
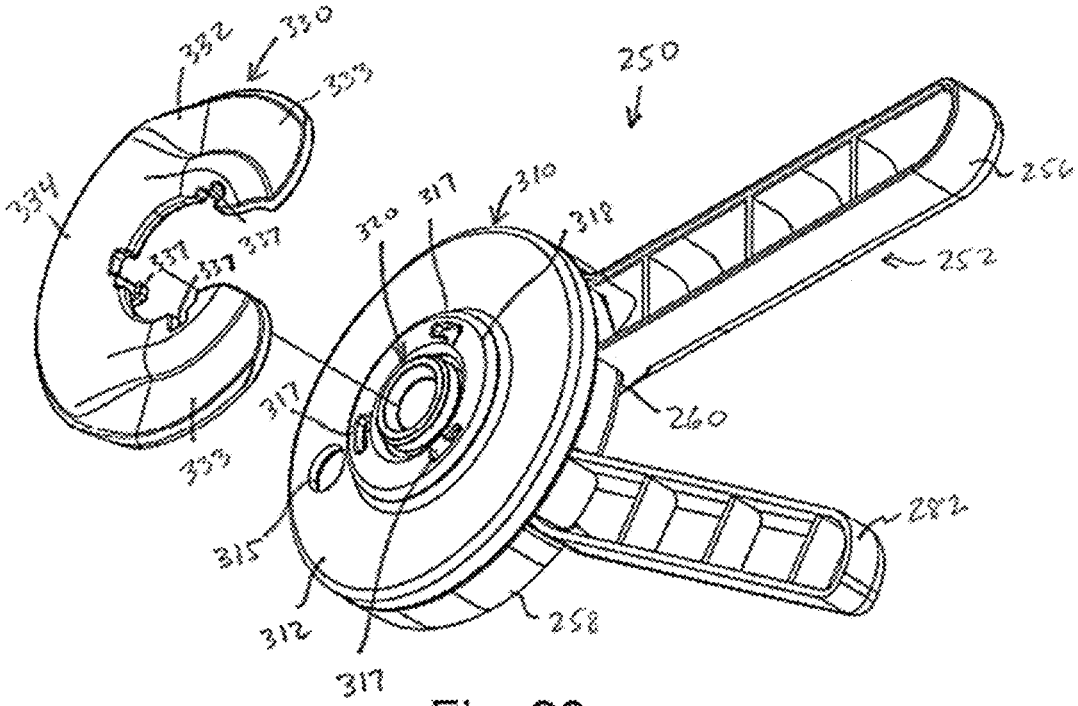
FIG. 22 is a bottom perspective view of the gem applicator assembly of FIG. 15 with the backing plate disconnected.
Figure 23:
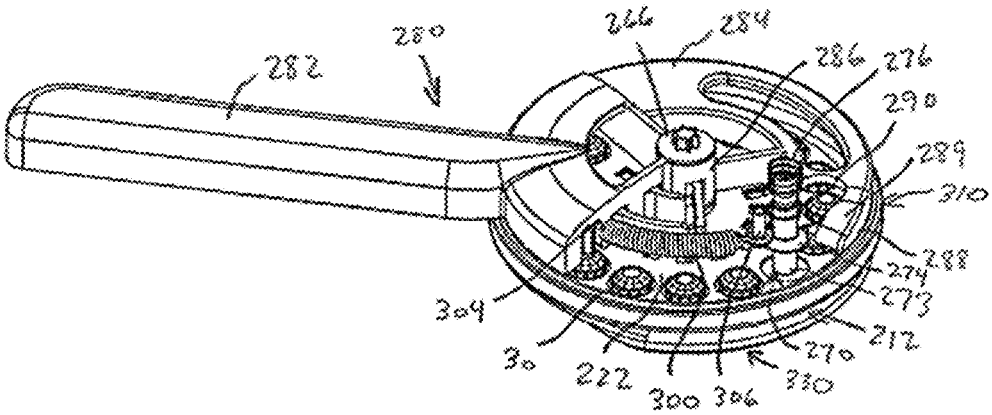
FIG. 23 is a perspective view of the gem applicator of FIG. 15 with the handle body removed and the actuation trigger in an initial position.

Referring to FIGS. 17-18, an exemplary gem dispenser 220 in the form of a disk 222 will be described. Each disk 222 includes a circular body 223 with a series of circumferentially spaced apart gem openings 224. In the illustrated embodiment, each disk body 223 also defines a central mounting hole 225 and a plurality of indexing slots 227. The disk body 223 of the present embodiment is defined by an adhesive sheet 230 positioned between opposed disk plates 226, 228. The disk plates 226, 228 and the adhesive sheet 230 each have corresponding central holes 225' and slots 227' which align to define the central mounting hole 225 and indexing slots 227 of the disk 222. With respect to the gem openings 224, the disk plates 226, 228 define corresponding openings 224', however, the adhesive sheet 230 is generally continuous, extending across the gem openings 224 defined by the plate openings 224'. The adhesive sheet 230 is preferably of a thickness that allows the adhesive sheet 230 to support a respective gem 30 positioned in each gem opening 224, however, to tear about the perimeter of the gem 30 as the gem 30 is pushed therethrough by plunger, as described hereinafter, such that the gem 30 has an adhesive backing as it is applied. Alternatively, the adhesive sheet 230 may be provided with perforations within each gem opening 224 with the perforations having a configuration similar to the perimeter configuration of the respective gem 30. The disk plates 226, 228 may be made of cardboard, polystyrene material, polyester, polycarbonate, paper, styrene, acrylic, polyethylene, polypropylene, and many other polymers. An exemplary adhesive material for the adhesive sheet 230, when the gems 30 are applied to hair, is 3M 1522 acrylic adhesive.

Referring to FIGS. 15, 16 and 19-22, the components of the gem applicator 250 of the present embodiment will be described. The handle body 252 generally comprises a handle member 256 extending from a hollow body 258 which defines a chamber 259. A slot 260 in the side of the hollow body 258 receives the actuation trigger 280 and defines the range of motion thereof. An opening 263 may be defined through the hollow body 258 and closed with a transparent member 265 to define a window into the chamber 259 to facilitate viewing of the disk 222 and gems 30 within the gem applicator 250.

A post 266 within the chamber 259 is configured to support the actuation trigger 280 for rotational movement relative to the handle body 252. The post 266 also defines a receiving bore 268 for receiving and securing the cover screw 320. The receiving bore 268 may have internal threads or may be otherwise configured to secure the cover screw 320.

A plunger guide 262 is also defined within the chamber 259 and is aligned with the opening 315 in the cover assembly 310 when the cover assembly 310 is attached to the handle body 252. The plunger guide 262 defines a passage 263 into which a portion of the push rod 272 of the plunger 270 is received. A through opening 264 may be provided through the hollow body 258 in alignment with the passage 263. The through opening 264 assists with molding, but also may provide guidance to the push rod 272, with a portion of the push rod 272 traveling into the through opening 264 thereby maintaining linear alignment, and/or facilitate a longer path of travel for the push rod 272. A pair of springs 276 and 278 are also positioned within the passage 263 and are configured to drive the push rod 272 and return the push rod 272, respectively, as will be described in more detail hereinafter. The driving spring 276 extends between un upper groove 275 in the push rod 272 and an end of the passage 263. The driving spring 276 is configured to compress while the plunger 270 is loaded and then release and drive the engagement end 273 of the push rod 272 through the opening 315 toward the application target area 212. The return spring 278 extends between a lower groove 277 in the push rod 272 and a securing washer 279 secured to the plunger guide 262. In the illustrated embodiment, the securing washer 279 defines a first hole 281 which aligns with the passage 263 and through which the plunger 270 passes. The securing washer 279 also defines a second hole 283 which receives and supports a spring post 306 as will be described hereinafter. The plunger 270 also includes a radial flange 274 extending from the push rod 272 outside of the plunger guide 262. The flange 274 is configured to be engaged by a portion of the actuation trigger 280 to load the plunger 270 as will be described.

The actuation trigger 280 generally comprises a handle member 282 and a drive portion 284. The drive portion 284 defines a central post receiving opening 286 configured to receive the post 266 of the handle body 252. A washer 285 is secured to the post 266 to retain the drive portion 284 rotationally secured within the chamber 259. The handle member 282 extends out of the slot 260 and is moveable within the slot 260 toward and away from the handle member 256. The drive portion 284 defines an opening 287 which aligns with the opening 263 in the hollow body 258 to allow viewing of the gem disk 222.

With reference to FIGS. 19 and 23-32, the drive portion 284 defines a drive ramp 288 configured to engage the flange 274 of the plunger 270 to facilitate actuation of the push rod 272. The drive ramp 288 includes a ramped surface 289 ramping from a lower height to an increasing height. A slot 291 extends through the ramped surface 289. The slot 291 has a width greater than the diameter of the push rod 272 but smaller than the diameter of the flange 274. At the top of the ramped surface 289, the drive portion 284 defines an actuation hole 290 which has an inside diameter which is greater than the diameter of the flange 274. As such, as the drive portion 284 is rotated toward the plunger 270, by moving the handle member 282 toward the handle member 256, the flange 274 will contact and ride up the ramped surface 289, with the push rod 272 passing through the slot 291. As the flange 274 moves up the ramped surface 289, the driving spring 276 is compressed, thereby loading the plunger 270. As the drive portion 284 continues to rotate, the flange 274 aligns with the actuation hole 290, at which point the plunger 270 is no longer retained and the drive spring 276 causes the push rod 272 to fire toward the application target area 212, with the engagement end 273 extending outside of the cover opening 315 (see FIG. 30). After firing, the actuation trigger 280 is released and the handle member 282 is moved in the opposite direction toward its original position. As the drive portion 284 moves in the opposite direction, the flange 274 moves under the drive ramp 288 (see FIGS. 31-32) until it is clear thereof, at which point the return spring 278 moves the plunger 270 to its original position.

In the illustrated embodiment, a reset spring 300 causes the actuation trigger 280 to automatically return to the original position. One end 301 of the reset spring 300 is attached to a post 304 defined by the drive portion 284 of the actuation trigger 280 and an opposite end 303 is attached to the post 306 secured within the washer 279 secured to the plunger guide 262 of the handle body 252. As such, as the actuation trigger 280 is moved in the actuation direction, the spring 300 is stretched. Once the actuation trigger 280 is released, the spring 300 causes rotation back to the original position.

Figure 24:
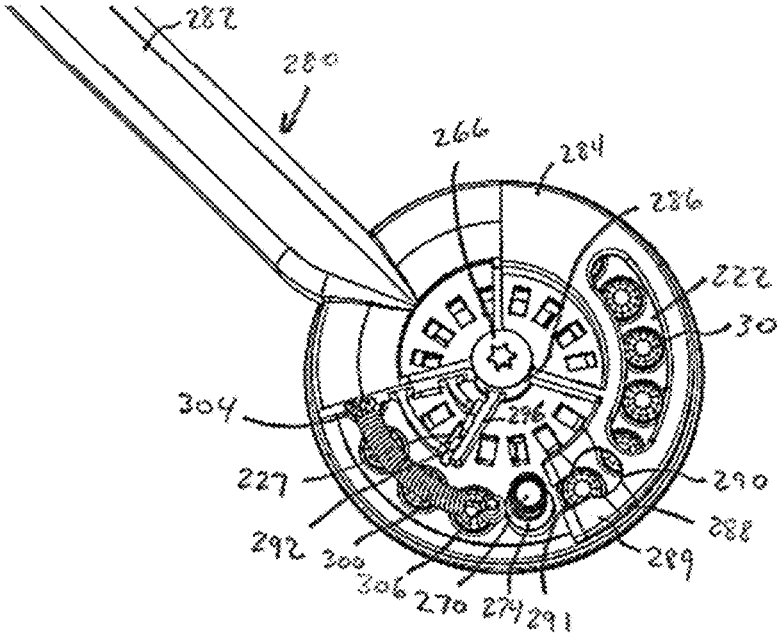
FIG. 24 is a top perspective view of the gem applicator of FIG. 15 with the handle body removed and the actuation trigger in an initial position.
Figure 25:
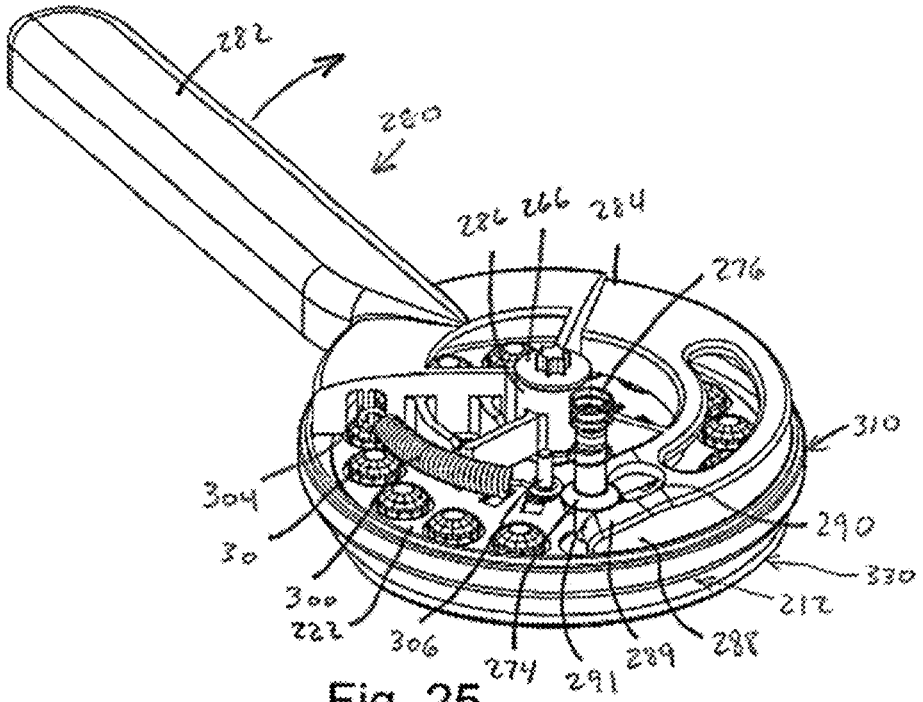
FIG. 25 is a top perspective view of the gem applicator of FIG. 15 with the handle body removed and the actuation trigger in a partially actuated position.
Figure 26:
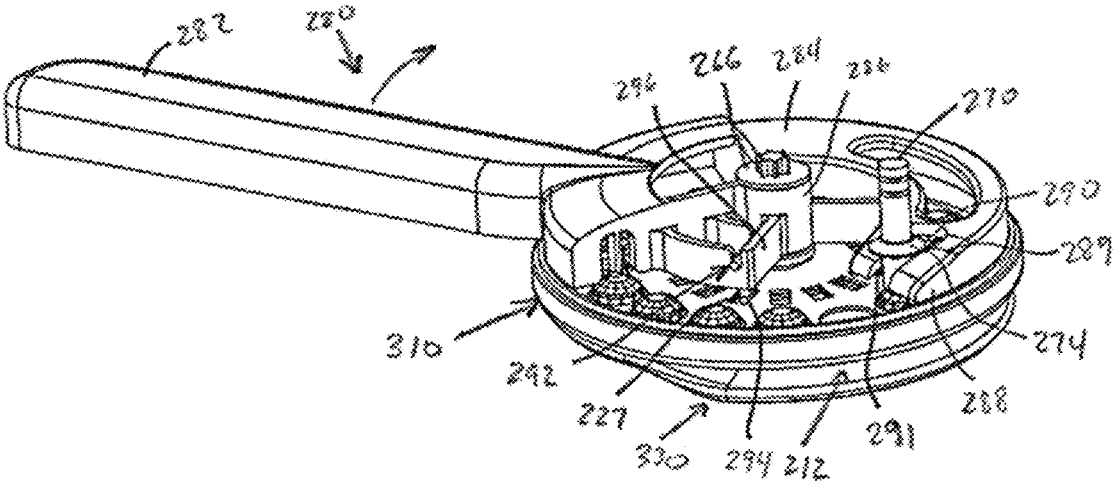
FIG. 26 is a perspective view of the gem applicator of FIG. 15 with the handle body and reset spring removed and the actuation trigger in a partially actuated position.
Figure 27:
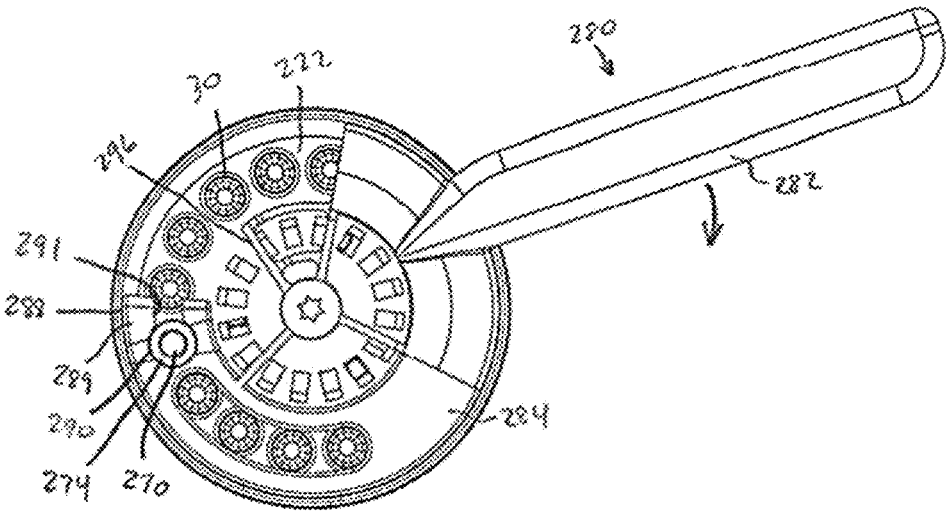
FIG. 27 is a top perspective view of the gem applicator of FIG. 15 with the handle body and reset spring removed and the actuation trigger in a fully actuated position and the plunger in a loaded position.
Figure 28:
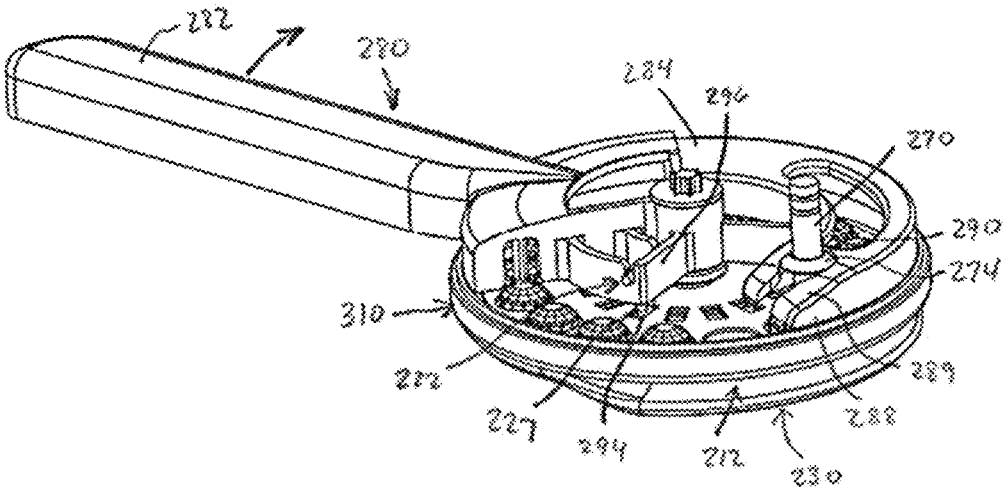
FIG. 28 is a perspective view of the gem applicator of FIG. 15 with the handle body and reset spring removed and the actuation trigger in a fully actuated position and the plunger in a loaded position.
Figure 29:
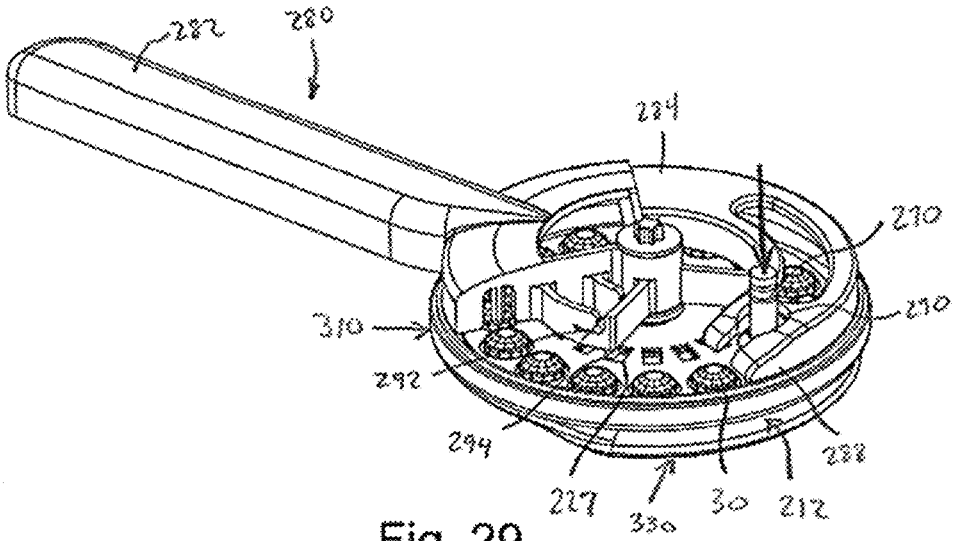
FIG. 29 is a perspective view of the gem applicator of FIG. 15 with the handle body and reset spring removed and the actuation trigger in a partially actuated position and the plunger in a fired position.
Figure 30:
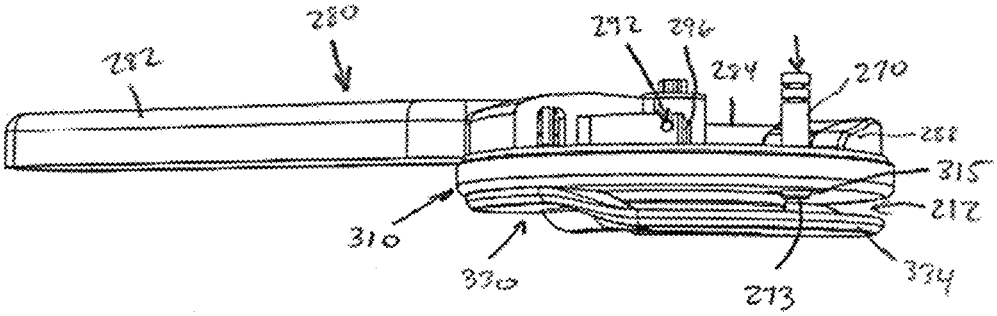
FIG. 30 is a side perspective view of the gem applicator of FIG. 15 with the handle body and reset spring removed and the actuation trigger in a partially actuated position and the plunger in a fired position.
Figure 31:
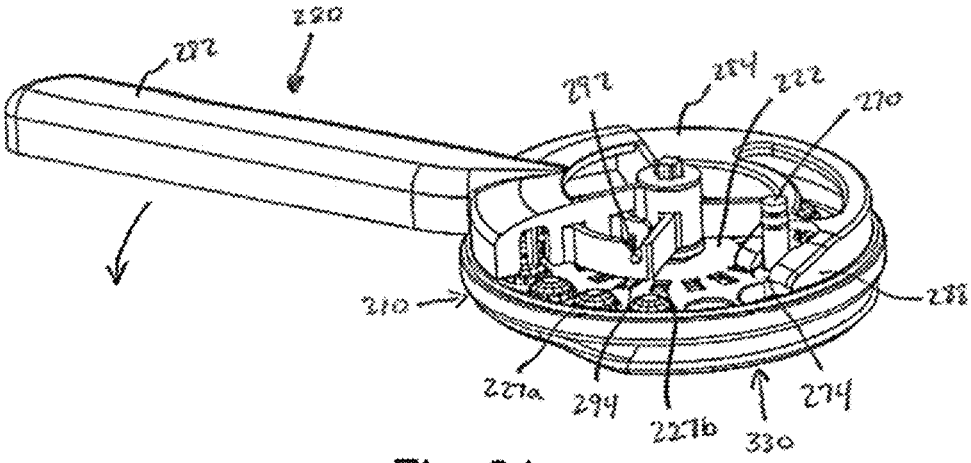
FIG. 31 is a perspective view of the gem applicator of FIG. 15 with the handle body and reset spring removed and the actuation trigger in a partially returned position.
Figure 32:
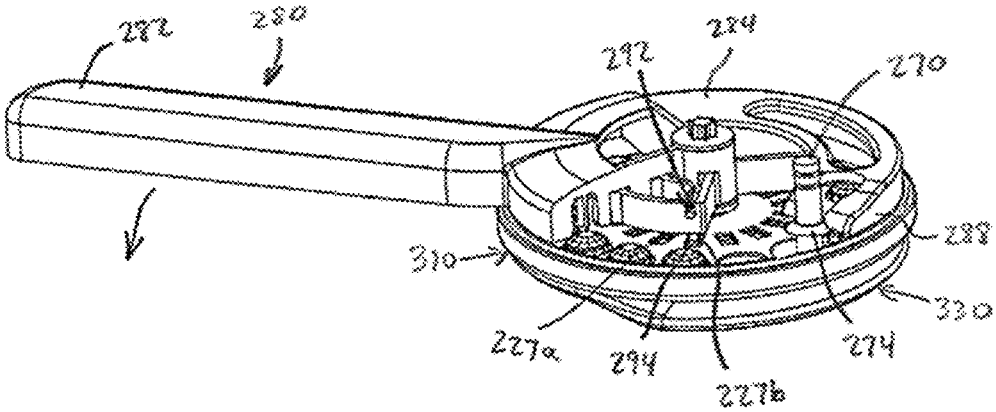
FIG. 32 is a perspective view of the gem applicator of FIG. 15 with the handle body and reset spring removed and the actuation trigger just prior to fully reaching the initial position.

The illustrated embodiment also includes an indexing assembly associated with the actuation trigger 280. Referring again to FIGS. 19 and 23-32, the index assembly includes an indexing clip 292 pivotally supported on the actuation trigger. The indexing clip 292 includes a contact end 294 and a pair of pivot member 293. Each pivot member 293 is received in a respective pivot support 295 defined by the drive portion 284 of the actuation trigger 280. The pivot supports 295 are adjacent to a stop wall 296 such that the indexing clip 292 can only pivot in one direction. As shown in FIGS. 24, 26 and 28, as the actuation trigger 280 is moved in the actuation direction, the stop wall 296 prevents the indexing clip 292 from pivoting. As such, the contact end 294 remains in a respective indexing slot 227 and moves the disk 222 in conjunction with the movement of the actuation trigger 280. Such movement of the disk 222 moves the next gem 30 into alignment with the plunger 270 and the cover opening 315. When the actuation trigger 280 is released, and the drive portion 284 begins to rotate in the opposite direction, the indexing clip 292 is free to pivot relative to the pivot supports 295. With such pivoting, the contact end 294 moves out of the indexing slot 227*a*, across the disk surface, and into the next indexing slot 227*b*, as shown in FIGS. 31 and 32. The index assembly is thereby reset and ready to index the disk 222 the next time the actuation trigger 280 is actuated.

Referring to FIGS. 19-22, the cover assembly 310 and the backing plate 330 of the present embodiment will be described. The cover assembly 310 includes a cover surface 312 with a perimeter rim 314 such that a disk receiving area 313 is defined within the cover assembly 310. A center post 316 is configured to be received in the central opening 225 of the disk 222 to align the disk 222 within the disk receiving area 313 and allow rotation thereabout. The cover opening 315 is defined through the cover surface 312 and is configured to be aligned with the plunger 270. A depending rim 318 extends from the bottom of the cover surface 312. A plurality of retention slots 317 are defined in the depending rim 318 and are configured to releasably receive corresponding tabs 337 on the removable backing plate 330. The cover screw 320 includes a shaft 322 and a head 324. The shaft 322 extends through the center post 316 of the cover assembly 310 and is engaged in the bore 268 defined by the post 266 to retain the screw 320, and thereby the cover assembly 310, connected to the handle body 252. The shaft 322 may include threads or some other connection configuration, for example, a press fit. The head 324 facilitates manipulation of the shaft 322 into and out of the bore 268. The cover screw 320 is removed and the cover assembly 310 easily removed to unload/load gem disks 222 into the disk receiving area 313.

The backing plate 330 is preferably removably connected to the cover assembly 310. When connected, the backing plate 330 defines a confined application target area 212 with a backing surface 334, for example, to hold hair when applying gems thereto. When the backing plate 330 is disconnected, the application target area 212 is unconfined, for example, to allow gems to be applied to a book, calendar, paper or the like. The illustrated backing plate 330 includes a u-shaped body 332, with the free ends 333 defining cover contact surfaces with angled surfaces 335 leading to the central backing surface 334. The angled surfaces 335 move the central backing surface 335 away from the cover assembly 310 to define the confined application target area 212. A central recessed area 336 is configured to receive the depending rim 318 of the cover assembly 310. A plurality of tabs 337 are defined within the recessed area 336 and are configured to be releasably received in the slots 317 defined by the depending rim 318. In the illustrated embodiment, the slots 317 have a large area to receive the tabs 337 and then the backing plate 330 is rotated slightly such that the tabs 337 are retained in a narrow portion of the slots 317. Various other releasable interconnections may be utilized. It is noted that the cover screw 320 does not interact with the backing plate 330 such that the cover assembly 310 may be removed and connected whether or not the backing plate 330 is attached.

Referring to FIGS. 33-42, another exemplary embodiment of a gem applicator assembly 410 in accordance with the disclosure will be described. Referring to FIGS. 33-37, the exemplary gem applicator assembly 410 generally comprises a gem dispenser 420 and a gem applicator 450. The gem applicator 450 is a purely mechanical device, to facilitate applying gems, for example, crystals, to hair, paper, cloth and or other materials (application target). In the present embodiment, the gem dispenser 420 is in the form of a disk which will be easily inserted into the applicator 450 via a hinged cover assembly 510 (see FIG. 37). The hinged cover assembly 510 provides an easy operation to replace the gem disk 422 so that, for instance, the user can change the color, shape and size of the gem the user wants to apply next. The applicator assembly 410 will cater for gems 30 of different size and shapes, thus making it more versatile in its use.

The applicator 450 includes a housing body 452, an actuation trigger 480 and the cover assembly 510. The disk 422 is supported between the body 452 and the cover assembly 510. The disk 422 is supported on a mount wheel 470, which serves as the support assembly of the present embodiment, positioned within a chamber 459 of the body 452 and rotatable therein. The mount wheel 470 is engaged by an indexing assembly associated with the actuation trigger 480 such that depression of the actuation trigger 480 causes rotation of the disk 422 to align a gem 30 with an opening 415 in the cover assembly 510 and an application opening 455 in the body 452. The actuation trigger 480 also drives the plunger 488 to push the gem 30 through the application opening 455 in the body 452 and toward the application target area 412 to apply the gem 30. A backing plate 530 may be utilized as a support at the application target area 412.

Figure 37:
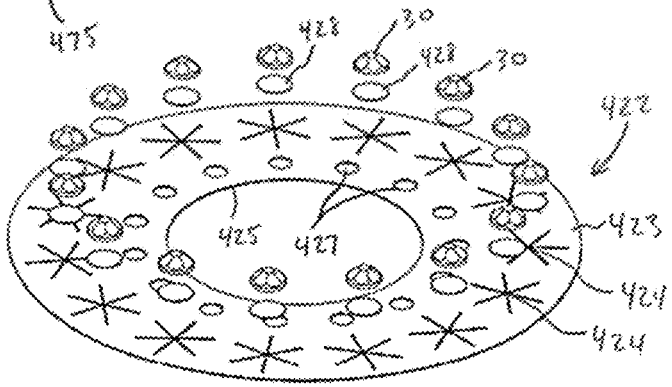
FIG. 37 is an exploded perspective view of another exemplary dispenser in the form of a disk.

Referring to FIG. 37, an exemplary gem dispenser 420 in the form of a disk 422 will be described. Each disk 422 includes a circular body 423 with a series of circumferentially spaced apart gem openings 424. In the illustrated embodiment, each disk body 423 also defines a central mounting hole 425 and a plurality of alignment holes 427. The disk body 423 of the present embodiment is defined by a single disk plate. The disk plate may be made of cardboard, polystyrene material, polyester, polycarbonate, paper, styrene, acrylic, polyethylene, polypropylene, and many other polymers. An adhesive tab 428 is positioned on the bottom surface of each gem 30. The adhesive tabs 428 initially hold the gems 30 in place on the disk body 423 aligned with a respective opening 424 and then adhere the gem 30 to the application target upon actuation of the plunger 470. An exemplary adhesive material for the adhesive tabs 428, when the gems 30 are applied to hair, is 3M 1522 acrylic adhesive.

Figure 38:
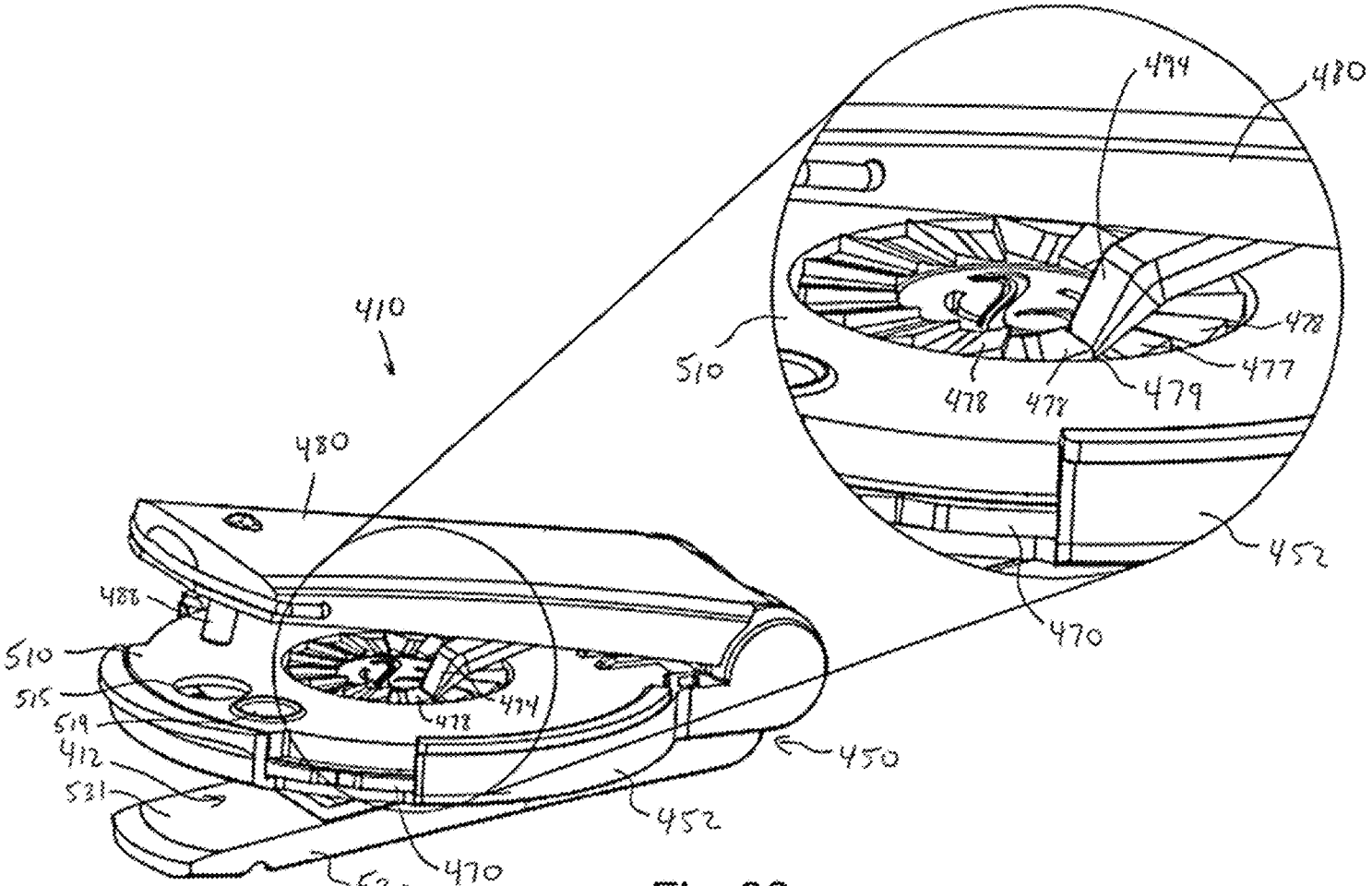
FIG. 38 is a top perspective view of the gem applicator of FIG. 33 with a portion thereof shown in expanded view.
Figure 39:
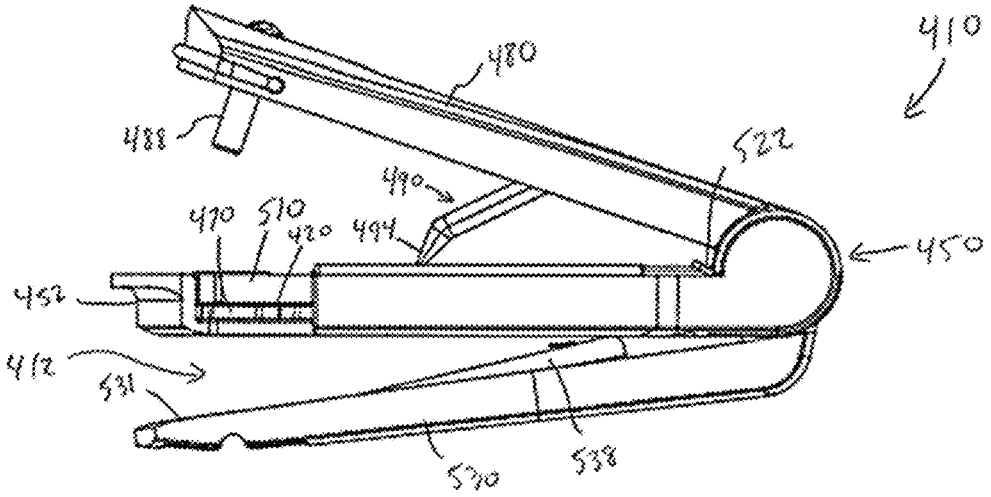
FIG. 39 is a side elevation view of the gem applicator of FIG. 33 in an initial position.
Figure 40:
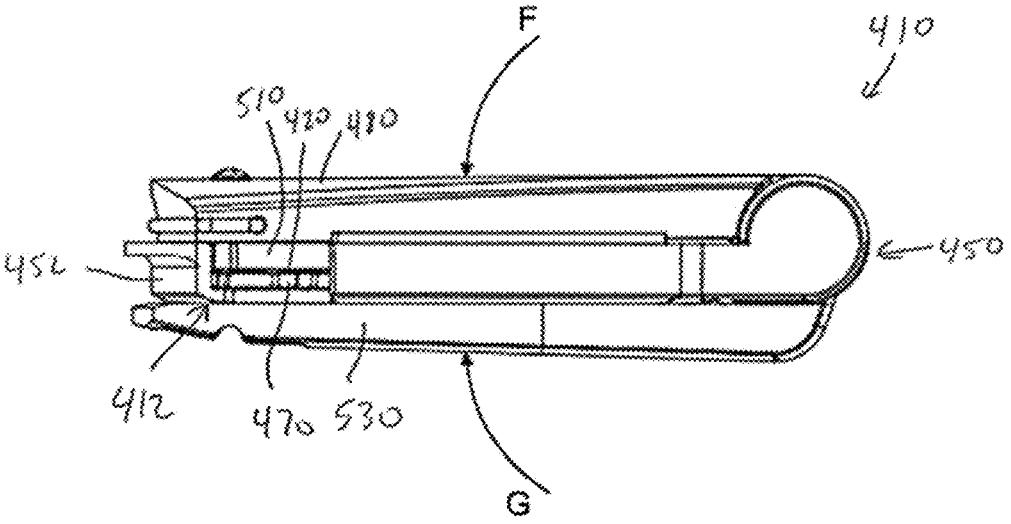
FIG. 40 is a side elevation view of the gem applicator of FIG. 33 in an application position.
Figure 41:
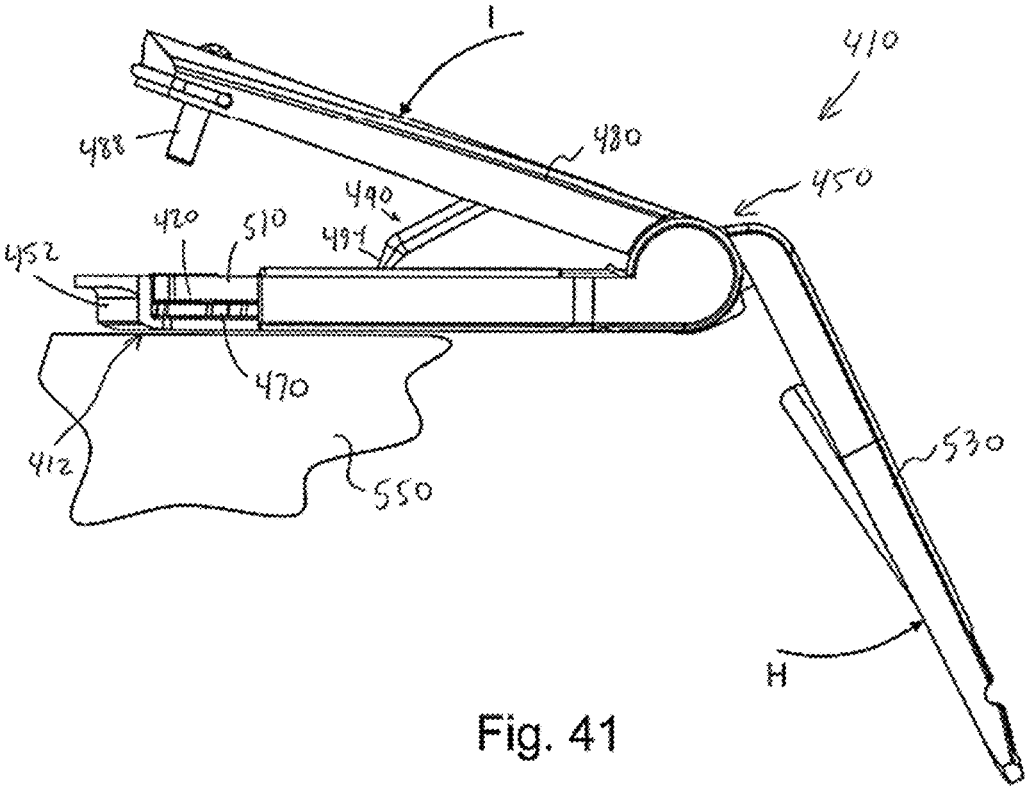
FIG. 41 is a side elevation view of the gem applicator assembly of FIG. 33 with the backing plate pivoted to a non-contact position.
Figure 42:
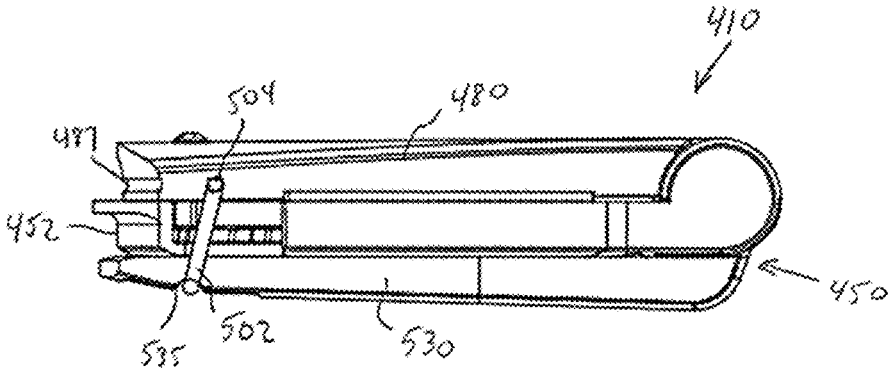
FIG. 42 is a side elevation view of the gem applicator of FIG. 33 in a locked condition.

Referring to FIGS. 33-36 and 38, the components of the gem applicator 450 of the present embodiment will be described. The housing body 452, the cover assembly 510, the actuation trigger 480 and the backing plate 530 are pivotally connecting to one another. A pair of pivot flanges 454 extend from the housing body 452 with each defining a pivot pin receiving slot 456. Similarly, a pair of pivot flanges 484 extend from the actuation trigger 480 and are positioned within the housing body pivot flanges 454. Each actuation trigger pivot flange 484 has a pivot pin hole 486. A pair of pivot flanges 514 extend from the body 512 of the cover assembly 510. The pivot flanges 514 are positioned within the actuation trigger pivot flanges 484. Each of the cover assembly pivot flanges 514 has a laterally extending post 511 with a through hole 516 extending therethrough. A torsion spring 522 extends about each of the posts 511 and is configured to engage portions of the actuation trigger pivot flanges 484 and portions of the cover assembly pivot flanges 514. As such, the torsion spring 522 biases the actuation trigger 480 to the initial position as shown in FIG. 39. The backing plate 530 also includes a pair of pivot flanges 534, each with a respective pivot pin hole 536, which are configured to be positioned between the cover assembly pivot flanges 514. During assembly, the backing plate pivot flanges 534, cover assembly pivot flanges 514 and actuation trigger pivot flanges 484 are positioned together with their respective holes 536, 516, 486 aligned. A pivot pin 451 is positioned through the holes 536, 516, 486 with the ends thereof extending beyond the actuation trigger pivot flanges 484. The ends of the pivot pin 451 are then snapped into the pivot pin receiving slots 456 of the housing body pivot flanges 454. Upon assembly, the cover assembly 510 and the actuation trigger 480 may be pivoted to the loading position shown in FIG. 36 and, after loading of a disk 422, pivoted back to the initial position shown in FIG. 39. Additionally, the actuation trigger 480 and the backing plate 530 may be pivoted from the initial position shown in FIG. 39 to the application position shown in FIG. 40. As an additional option, the backing plate 530 may be pivoted to a non-contact position as indicated by arrow H in FIG. 41. The non-contact position allows the housing body 452 to be positioned directly on the application target 550, for example, a hair braid on the top of the head.

The illustrated housing body 452 and mount wheel 470 will be described in more detail with reference to FIGS. 33-36. The mount wheel 470 has a generally planar body 472 having a circular configuration configured to fit within the chamber 459 of the housing body 452. A snap post 473 extends from a lower surface of the planar body 472 and is received within a hole 466 in the housing body 452 to secure the mount wheel 470 within the chamber 459 (see FIG. 34). The planar body 472 defines a plurality of circumferentially spaced through holes 474, each configured to align with a respective gem 30 on the gem dispenser 420. The upper surface of the wheel body 472 defines a plurality of disk engagement projections 475 configured to extend into the disk alignment holes 427 to properly align the disk 422 and cause the disk 422 to rotate in conjunction with rotation of the mount wheel 470. The side surface of the wheel body 472 defines an indexing notch 471 in between each of the through holes 474. An indexing ball 461 is positioned within a slot 460 in the housing body 452 and is biased by a spring 463 into engagement with the indexing notches 471. The spring 463 is retained in a hole 462 in the side wall of the housing body 452. As the mount wheel 470 is rotated, the ball 461 rides up the slope of the indexing notch 471 and out of engagement therewith. Once the ball 461 is aligned with the next indexing notch 471, the spring 463 biases the ball 461 into engagement with that next indexing notch 471, thereby indicating proper alignment of the mount wheel 470 and disk 422 with the application opening 455.

The housing body 452 has a pair of slots 457 in the side walls which facilitate access to the wheel mount 470. A user can manually rotate the mount wheel 470 via the slots 457. In this regard, the indexing notches 471 further serve to provide a contoured surface to facilitate such manual rotation of the mount wheel 470. The mount wheel 470 will also automatically rotate via an indexing assembly 490 which engages a plurality of indexing members 478 extending from a central portion of the mount wheel 470. Each indexing member 478 includes a ramped surface 477 and a perpendicular surface 479 (see FIG. 38). As will be described in more detail hereinafter, the indexing assembly 490 is configured to contact the perpendicular surface 479 and cause the mount wheel 470 to rotate as the actuation trigger 480 is depressed and to ride up the ramped surface 477 to the next perpendicular surface 479 when the actuation trigger 480 is released.

The actuation trigger 480 has a generally planar body 482 extending from the pivot flanges 484 to a free end. The plunger 470 extends from the lower surface of the free end of the trigger body 482. In the illustrated embodiment, the plunger 488 is a separate component which is connected to the trigger body 482 via a screw 489, however, the plunger 488 may be formed unitary with the trigger body 482. In the illustrated embodiment, a gem cover 491 covers the screw 489. The plunger 488 is positioned such that upon depression of the actuation trigger 480, the plunger 488 will pass through the opening 515 in the cover assembly 510, engage the gem 30 aligned therewith, and push the gem through the application opening 455 in the housing body 452 to the application area 412.

Figure 34:
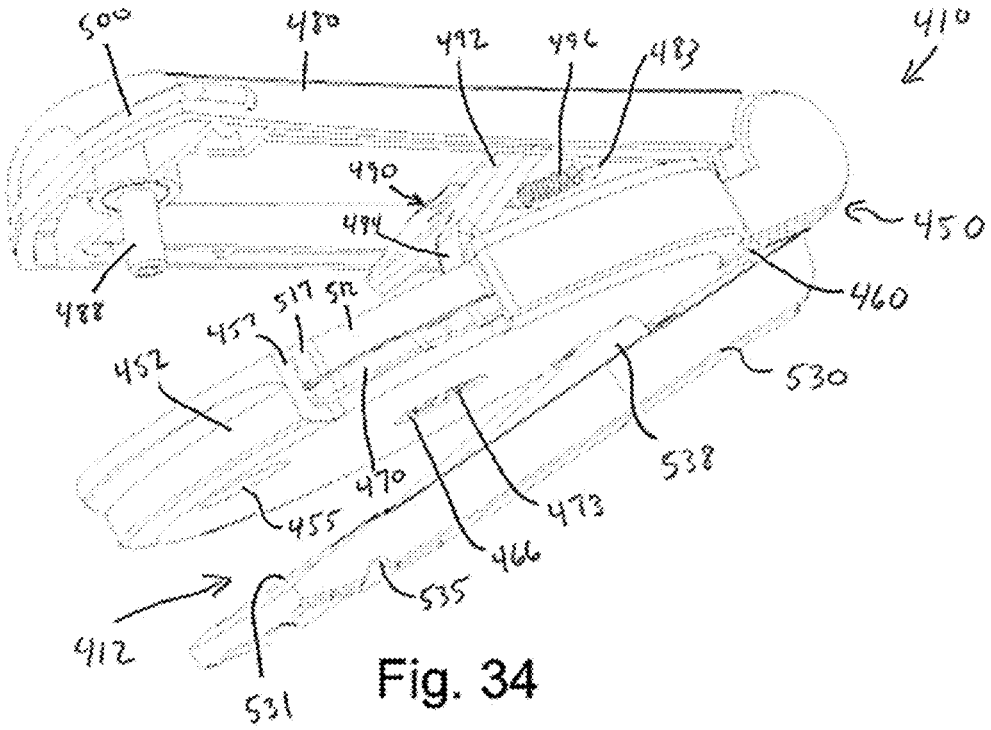
FIG. 34 is a bottom perspective view of the gem applicator assembly of FIG. 33.
Figure 35:
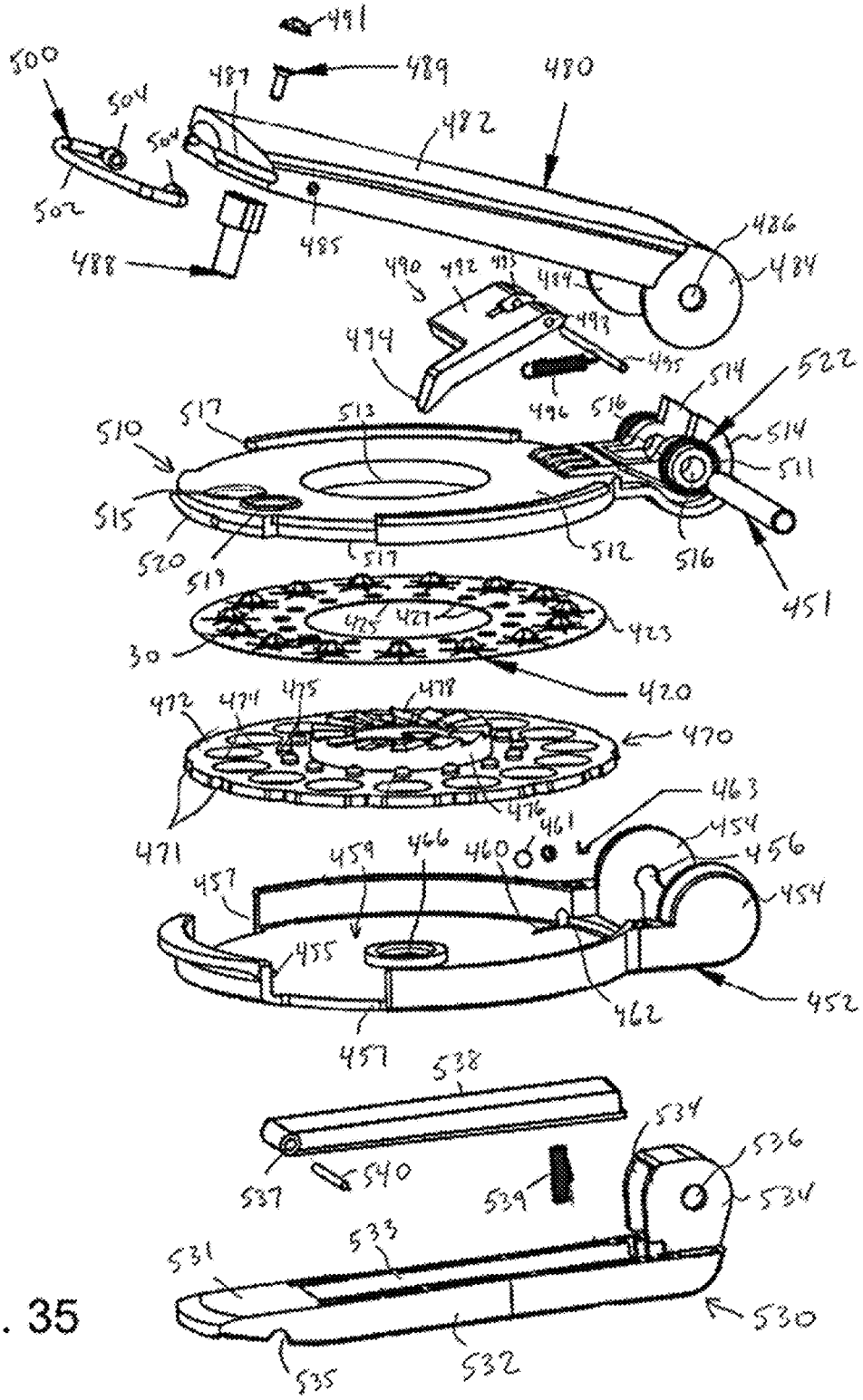
FIG. 35 is an exploded perspective view of the gem applicator assembly of FIG. 33.

The actuation trigger 480 also supports the indexing assembly 490. The indexing assembly 490 includes a body 492 which is pivotally connected to the lower side of the trigger body 482 via a pivot pin 495 extending through holes 493 in the indexing body 492. Referring to FIG. 34, a spring 496 extends from a mount 483 on the lower surface of the trigger body 492 to a rear surface of the indexing body 492 and biases the indexing body 492 rearward. A forward end of the indexing body 492 defines an indexing finger 494 configured to engage the indexing members 478 on the mount wheel 470. With reference to FIG. 38, when the actuation trigger 480 is in the initial position, the spring 496 pulls the indexing body 492 rearward such that the indexing finger 494 aligns with and engages the perpendicular surface 479 of a respective indexing member 478. As the actuation trigger 480 is depressed, the indexing body 492 pivots relative to the trigger body 482, thereby causing the indexing finger 494 to advance forward. As the indexing finger 494 advances forward, engagement with the perpendicular surface 479 causes the mount wheel 470 to rotate and index to the next gem 30. Upon release of the actuation trigger 480, the trigger 480 will be biased back to the initial position via the spring 522. As the actuation trigger 480 moves to the initial position, the spring 496 causes the indexing body 492 to pivot rearward with the indexing finger 494 riding up the ramped surface 477 of the next indexing member 478 until the indexing finger 494 is aligned with and engages the next perpendicular surface 479. The actuation trigger 480 and indexing assembly 490 are now reset for application of the next gem 30.

Figure 33:
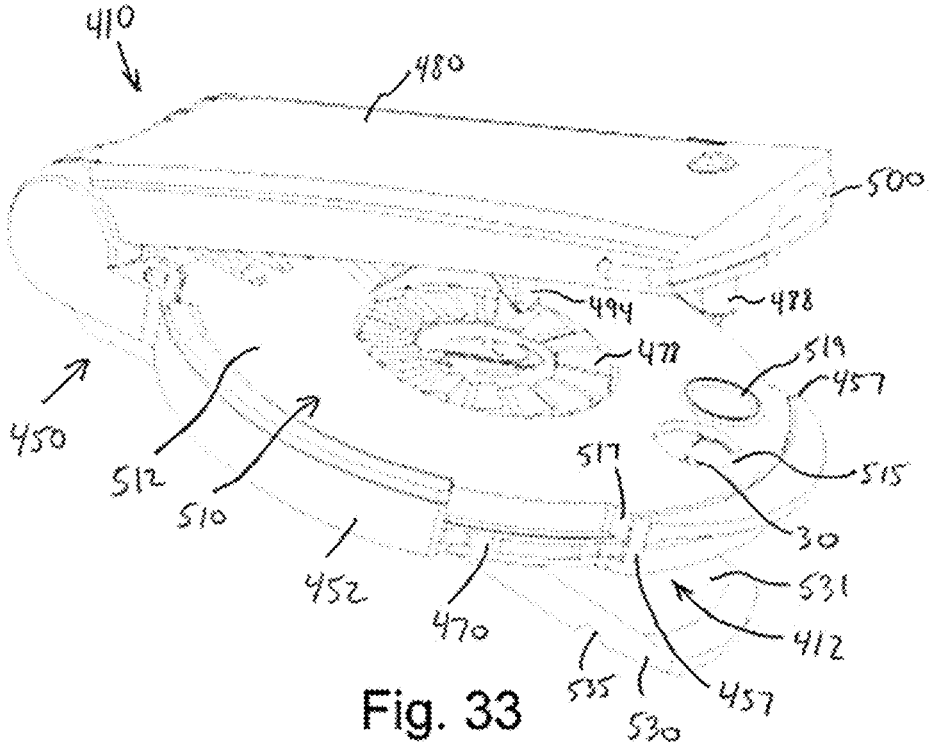
FIG. 33 is a top perspective view of a gem applicator assembly in accordance with another embodiment of the disclosure.

In the illustrated embodiment, the actuation trigger 480 also supports a lock mechanism 500. The lock mechanism 500 includes an elastic band 502 extending between a pair of mounting posts 504. Each mounting post 504 is received in a respective hole 485 in the side of the trigger body 482. In an unlocked condition, the elastic band 502 may be stored in a storage slot 487 extending across the front of the trigger body 482 as shown in FIGS. 33 and 34. To lock the gem applicator 450 in a closed position, similar to that shown in FIG. 42, for example, for transport, the elastic band 502 is moved from the storage slot 487 on the actuation trigger 480 to a locking slot 535 on the bottom surface of the backing plate 530. Other locking mechanism may alternatively be utilized.

Figure 36:
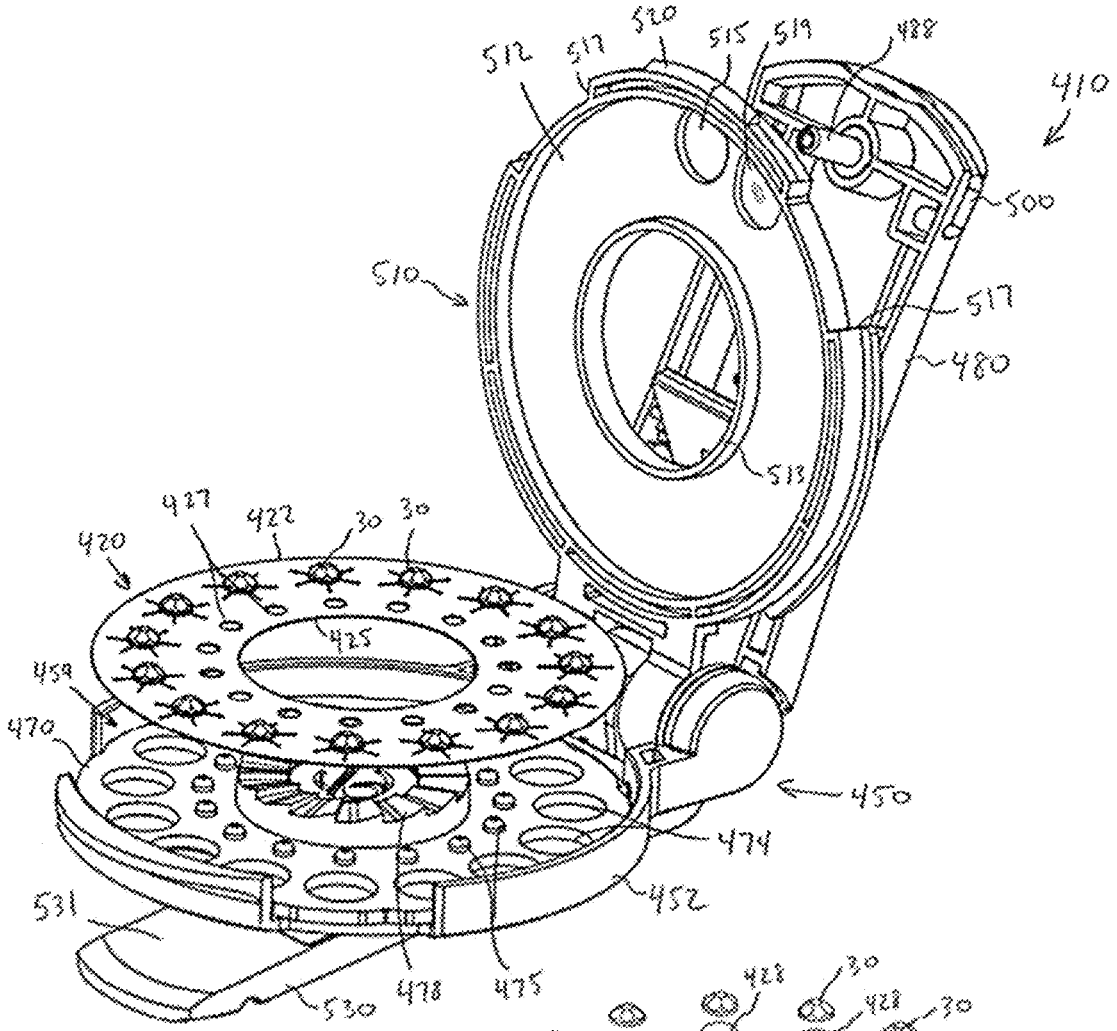
FIG. 36 is a perspective view of the gem applicator of FIG. 33 in a disk loading position.

The cover assembly 510 includes the cover body 512 extending from the cover assembly pivot flanges 514. The cover body 512 is configured to fit within the chamber 459 of the housing body 452 with an engaging fit such that the cover body 512 will generally remain in a closed position, as shown in FIG. 33, unless a force is applied to move it to an open, loading position, as shown in FIG. 36. In the illustrated embodiment, a lip 520 extends from a front portion of the cover body 512 and is configured to engage the housing body 452. The cover body 512 has a central opening 513 through which the mount wheel indexing members 478 extend when the cover assembly 510 is in the closed position. As described above, the cover body 512 defines a through hole 515 which is aligned with the plunger 488 and the application hole 455 such that the plunger 488 passes through the hole 515 and engages a gem 30 when the actuation trigger 480 is depressed. Since the indexing assembly 490 moves the mount wheel 470 as the actuation trigger is depressed, the gem location one spot counterclockwise from the application hole 455 will be moved into alignment with the alignment hole 455 prior to the plunger 488 passing through the through hole 515. To allow the user to see which gem 30 will be applied when the actuation trigger 480 is depressed, a viewing window 519 is provided through the cover body 512 in alignment with the gem 30 located one spot counterclockwise from the application hole 455. If the user is manually indexing the mount wheel 470, they will rotate the mount wheel 470 until the desired gem 30 is in view within the viewing window 519. Depression of the actuation trigger 480 will index the gem within the viewing window 519 to alignment with the application hole 455 and thereafter the plunger 488 will push the desired gem through the application hole 455 toward the application target area 412. It is noted that the cover body 512 may include slots 517 which align with the slots 457 in the housing body 452 to make the mount wheel 470 more accessible.

As described above, the backing plate 530 is preferably pivotably connected to the housing body 452 and moveable between a contact position and a non-contact position. Alternatively, instead of pivoting to a non-contact position, the backing plate 530 may be configured to be removable. When in the contact position as illustrated in FIGS. 33 and 34, the backing plate 530 defines a confined application target area 512 with a backing surface 531, for example, to hold hair when applying gems thereto. When the backing plate 530 is in the non-contact position, the application target area 412 is unconfined, for example, to allow gems to be applied to the top of the head, a book, calendar, paper or the like. The illustrated backing plate 530 includes a body 532 extending from the pivot flanges 534 to the backing surface 531. The body 532 defines a cavity 533 in which a return member 538 is positioned. The return member is pivotally connected within the cavity 533 with a pivot pin 540 extending through an opening 537 in one end of the return member 538. A spring 539 is positioned between the backing plate body 532 and the return member 538 such that the free end of the return member 538 is biased out of the cavity 533. As such, when an application force is removed from the backing plate 530, the return member 538 is biased against the lower surface of the housing body 452 and moves the backing plate 530 away therefrom, opening the application target area 412, as shown in FIG. 34.

Having generally described the components of the gem applicator assembly 410, operation thereof will now be described with reference to FIGS. 36 and 38-41. Initially, the cover assembly 510 is moved to an open, loading position as illustrated in FIG. 36. A disk 422 with one or more gems 30 thereon is loaded onto the mount wheel 470 with the disk engagement projections 475 extending into the disk alignment holes 427 and the indexing members 478 extending through the opening 425. With the disk 422 in position, the cover assembly 510 is moved to the closed position illustrated in FIG. 38 with the gem applicator assembly 410 now in an initial position ready for gem application.

The user may manually rotate the mount wheel 470 until a desired gem 30 is aligned with the viewing window 519. With the desired gem 30 so aligned, the user than positions the gem applicator 450 such that a desired application target is within the application target area 412 between the backing surface 531 and the housing body 452. With the application target so positioned, the user applies forces to the actuation trigger 480 and the backing plate 530 as indicated by arrows F and G in FIG. 40. As an example, the gem applicator 450 may be held like a staple remover, with the fingers applying the force F to the actuation trigger 480 and the thumb applying the force G to the backing plate 530. If the application target can not be positioned between the backing plate 530 and the housing body 452, the backing plate 530 may be pivoted to the non-contact position, as indicated by arrow H in FIG. 41, and the housing body 452 positioned directly on the application target 550. With the housing body 452 so positioned, the user applies an application force to the actuation trigger 480 as indicated by arrow I.

In either scenario, as the actuation trigger 480 is moved toward the housing body 452, the indexing finger 494 will engage a respective indexing member 478 and cause the mount wheel 470, thereby aligning the desired gem 30 with the application hole 455. The plunger 488 will pass through the hole 515 in the cover body 512, contact the gem 30 and push it through the disk opening 424 and the application opening 455 toward the application target area 412. The gem 30 is delivered to the application target area 412 with the adhesive tab 428 contacting and applied to the application target. Upon release of the application force, the spring 522 urges the actuation trigger 480 to the initial position and the return member 538 urges the backing plate 530 to the initial position. As the actuation trigger 480 moves to the initial position, the indexing assembly is reset.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A gem applicator assembly comprising:

a dispenser supporting a plurality of gems, each gem having an adhesive backing; and an applicator comprising:

a body;

a support assembly supported by the body and configured to receive and support the dispenser with one of the gems alignable with an application target area; and a plunger supported relative to the body and movable relative thereto between an initial position and an application position wherein the plunger engages an aligned gem and pushes the gem such that the adhesive backing of the aligned gem moves toward the application target area.

2. The gem applicator assembly according to claim 1 wherein the plunger is supported on an actuation trigger which is pivotally mounted relative to the body.

3. The gem applicator assembly according to claim 2 wherein the plunger is biased to the initial position by a resilient member biasing the actuation trigger.

4. The gem applicator assembly according to claim 2 wherein actuation of the actuation trigger causes automatic indexing of the dispenser such that a next one of the gems is aligned with the application target area.

5. The gem applicator assembly according to claim 4 wherein an indexing assembly is pivotally mounted on the actuation trigger, the indexing assembly configured to engage a portion of the support assembly and cause rotation thereof as the actuation trigger is moved toward the body.

6. The gem applicator assembly according to claim 5 wherein the support assembly is defined by a mount wheel positioned within the body and the wheel mount defines a plurality of indexing members which are engaged by the indexing assembly.

7. The gem applicator assembly according to claim 6 wherein a cover assembly encloses the mount wheel within the body.

8. The gem applicator assembly according to claim 7 wherein the cover assembly defines an opening therethrough aligned with the application target area.

9. The gem applicator assembly according to claim 8 wherein the cover assembly defines a viewing window adjacent the opening, the viewing window aligned with a next of the gems that will be moved into alignment with the application target area upon actuation of the actuation trigger.

10. The gem applicator assembly according to claim 1 wherein the support assembly is defined by a mount wheel positioned within the body.

11. The gem applicator assembly according to claim 10 wherein a cover assembly encloses the mount wheel within the body.

12. The gem applicator assembly according to claim 11 wherein the cover assembly defines an opening therethrough aligned with the application target area.

13. The gem applicator assembly according to claim 1 wherein the applicator further comprises a backing plate positioned proximate the application target area.

14. The gem applicator assembly according to claim 13 wherein the backing plate is pivotal to a non-contact position spaced from the application target area.

15. The gem applicator assembly according to claim 1 wherein the dispenser is in the form of a gem disk.

16. The gem applicator assembly according to claim 15 wherein the gem disk includes a plurality of circumferentially spaced gem openings.

17. The gem applicator assembly according to claim 16 wherein a respective adhesive tab defines the adhesive backing of each of the gems.

18. A gem dispenser comprising:

a disk having a circular configuration;

a plurality of spaced apart gem openings extending through the disc; and a plurality of adhesive backed gems positioned on the disk, each gem aligned with a respective gem opening.

19. The gem dispenser according to claim 18 wherein a plurality of radial slits extend from each gem opening.

20. The gem dispenser according to claim 18 wherein at least one alignment through hole is defined through the disk radially inward of the plurality of spaced apart gem openings.

* * * * *